US012329199B2

(12) United States Patent
Aller et al.

(10) Patent No.: US 12,329,199 B2
(45) Date of Patent: Jun. 17, 2025

(54) AEROSOL DELIVERY DEVICE WITH IMPROVED MOUTHPIECES

(71) Applicant: R.J. Reynolds Tobacco Company, Winston-Salem, NC (US)

(72) Inventors: Jared Aller, Winston-Salem, NC (US); Thaddeus Jackson, Summerfield, NC (US); Karen H. Cleckley, Kernersville, NC (US); Daniel W. Rennecker, Naperville, IL (US); Matthew J. Nettenstrom, Bartlett, IL (US); Steven M. Schennum, Plainfield, IL (US)

(73) Assignee: R.J. Reynolds Tobaco Company, Winston-Salem, NC (US)

( * ) Notice: Subject to any disclaimer, the term of this patent is extended or adjusted under 35 U.S.C. 154(b) by 389 days.

(21) Appl. No.: 17/898,839

(22) Filed: Aug. 30, 2022

(65) Prior Publication Data

US 2024/0065321 A1 Feb. 29, 2024

(51) Int. Cl.

| | |
|---|---|
| ***A24F 40/42*** | (2020.01) |
| ***A24F 40/46*** | (2020.01) |
| ***A24F 40/50*** | (2020.01) |

(52) U.S. Cl.

CPC ..... *A24F 40/42* (2020.01); *A24F 40/46* (2020.01); *A24F 40/50* (2020.01)

(58) Field of Classification Search

None

See application file for complete search history.

(56) References Cited

U.S. PATENT DOCUMENTS

| | | | |
|---|---|---|---|
| 1,464,300 | A | 8/1923 | Taff |
| 1,505,655 | A | 8/1924 | Marek |

(Continued)

FOREIGN PATENT DOCUMENTS

| | | | |
|---|---|---|---|
| CN | 104585884 | B | 4/2018 |
| EP | 3213649 | A1 | 9/2017 |

(Continued)

OTHER PUBLICATIONS

International Search Report and Written Opinion issued in PCT Application No. PCT/IB2023/058541, mailed Feb. 2, 2024, 18 pages.

*Primary Examiner* — Manley L Cummins, IV

(74) *Attorney, Agent, or Firm* — Womble Bond Dickinson (US) LLP; R. Flynt Strean

(57) ABSTRACT

Disclosed are aerosol delivery devices for use with a removable and replaceable cartridge, where the device includes an improved mouthpiece, such as one that is removable or customizable. The device includes a holder defining a receiving chamber configured to receive a removable cartridge comprising an ignitable heat source and a substrate portion that includes a substrate material having an aerosol precursor composition configured to form an aerosol upon application of heat thereto and a first aerosol passageway and a mouthpiece with a first end and a longitudinally opposed second end defining a second aerosol passageway, where the first end is configured to engage with a user's mouth and the second end is coupleable to the proximal end of the holder. The mouthpiece can be removed for cleaning and then reattached for continued use or, in some cases, a different mouthpiece may be attached to customize the user's experience.

17 Claims, 23 Drawing Sheets

(56) References Cited

U.S. PATENT DOCUMENTS 1,541,891 A 6/1925 Becker
1,607,132 A 11/1926 Shichigoro
1,613,545 A 1/1927 Teigen
1,941,531 A 1/1934 Blankenship
2,008,433 A 7/1935 Ashour
2,373,629 A 4/1945 Daugherty
2,455,492 A 12/1948 Jackson
2,502,831 A 4/1950 Henry
2,541,837 A 2/1951 Schroff
2,701,571 A 2/1955 Dittrich
2,711,176 A 6/1955 Vakilian
2,779,340 A 1/1957 Mansfield
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banerjee et al.
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A 8/1993 Ehrman et al.
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
9,078,473 B2 7/2015 Worm et al.
9,149,072 B2 10/2015 Conner et al.
9,220,301 B2 12/2015 Banerjee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,943,114 B2 4/2018 Batista
9,961,939 B2 5/2018 Reevell
10,022,014 B2 7/2018 Mateos Martin et al.
10,034,493 B2 7/2018 Akiyama et al.
10,062,015 B2 8/2018 Besehanic
10,064,428 B2 9/2018 Swepston et al.
10,064,478 B2 9/2018 Brooks
10,082,015 B2 9/2018 Williams et al.
10,102,013 B2 10/2018 Preston et al.
10,111,463 B2 10/2018 Batista
10,132,009 B2 11/2018 Chou et al.
10,159,277 B2 12/2018 Bonnely
10,212,014 B2 2/2019 Qu et al.
10,212,968 B2 2/2019 Mironov et al.
10,222,015 B2 3/2019 Chien
10,262,017 B2 4/2019 Wolge
10,291,991 B2 5/2019 Shan et al.
10,301,990 B2 5/2019 De Smet et al.
10,302,018 B2 5/2019 Venter
10,312,017 B2 6/2019 Huang et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,827,780 B2 11/2020 Swepston et al.
2008/0047570 A1 2/2008 Plank
2009/0065011 A1 3/2009 Maeder et al.
2011/0083674 A1 4/2011 Karpinsky
2013/0133675 A1 5/2013 Shinozaki et al.
2013/0167850 A1 7/2013 Al-Aawar
2013/0228190 A1 9/2013 Weiss et al.
2013/0298905 A1* 11/2013 Levin ..... A24F 40/90 128/202.21
2014/0048085 A1 2/2014 Cox
2014/0283860 A1* 9/2014 Stolz ..... A24B 15/165 131/330
2015/0034100 A1 2/2015 Park et al.
2015/0040924 A1 2/2015 Mironov et al.
2015/0107759 A1* 4/2015 Poget ..... A24D 1/22 156/245
2015/0157051 A1* 6/2015 Mironov ..... A24C 5/00 131/328
2015/0216231 A1* 8/2015 Roudier ..... A24F 42/00 131/330
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0345626 A1* 12/2016 Wong ..... A24F 40/50
2016/0360785 A1 12/2016 Bless et al.
2017/0000189 A1 1/2017 Mironov et al.
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0035712 A1* 2/2018 Zhou ..... A24F 40/485
2018/0070640 A1 3/2018 Bessant et al.
2018/0098571 A1* 4/2018 Watson ..... A24F 7/02
2018/0116280 A1 5/2018 Maiwald et al.
2018/0192707 A1 7/2018 Worm et al.
2018/0317560 A1 11/2018 Shinozaki et al.
2018/0325167 A1 11/2018 Grant
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0029315 A1* 1/2019 Malgat ..... A24D 1/22
2019/0059449 A1 2/2019 Akiyama et al.
2019/0059450 A1 2/2019 Akiyama et al.
2019/0075848 A1 3/2019 Worm et al.
2019/0124972 A1 5/2019 Nakano
2019/0124973 A1 5/2019 Nakano et al.

(56) References Cited

U.S. PATENT DOCUMENTS

| | | | | |
|---|---|---|---|---|
| 2019/0124974 | A1* | 5/2019 | Dimmick | A24D 3/061 |
| 2019/0133176 | A1 | 5/2019 | Nakano et al. | |
| 2019/0150505 | A1 | 5/2019 | Ceppi et al. | |
| 2019/0274358 | A1 | 9/2019 | Reevell | |
| 2020/0015519 | A1 | 1/2020 | Conner et al. | |
| 2020/0060333 | A1 | 2/2020 | Sutton et al. | |
| 2020/0146349 | A1 | 5/2020 | Phillips et al. | |
| 2020/0196677 | A1 | 6/2020 | Liu | |
| 2020/0260777 | A1* | 8/2020 | Rojo-Calderon | A24D 1/22 |
| 2020/0268044 | A1 | 8/2020 | Wilson | |
| 2020/0316325 | A1* | 10/2020 | Reevell | A61M 15/06 |
| 2021/0015172 | A1 | 1/2021 | Conner et al. | |
| 2021/0015174 | A1 | 1/2021 | Cox et al. | |
| 2021/0015175 | A1 | 1/2021 | Jackson et al. | |
| 2021/0235754 | A1 | 8/2021 | Yamada et al. | |
| 2022/0225674 | A1* | 7/2022 | Ruscio | A24D 1/20 |
| 2022/0225677 | A1* | 7/2022 | Gallant | A24F 40/485 |

FOREIGN PATENT DOCUMENTS

| | | | |
|---|---|---|---|
| JP | 2002034543 | | 2/2002 |
| JP | 2021-166519 | A | 10/2021 |
| WO | WO1995034226 | | 12/1995 |
| WO | WO1998054989 | | 12/1998 |
| WO | WO2009022232 | | 2/2009 |
| WO | WO2013072336 | | 5/2013 |
| WO | WO2013083963 | | 6/2013 |
| WO | WO2013149810 | | 10/2013 |
| WO | WO2013189836 | | 12/2013 |
| WO | WO2014037270 | | 3/2014 |
| WO | WO2014156838 | | 10/2014 |
| WO | WO2014180893 | | 11/2014 |
| WO | WO2015097005 | | 7/2015 |
| WO | WO2015128384 | | 9/2015 |
| WO | WO2015151158 | | 10/2015 |
| WO | WO2015184744 | | 12/2015 |
| WO | WO2015197850 | | 12/2015 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | WO2017207442 | | 12/2017 |
| WO | WO2017212284 | | 12/2017 |
| WO | WO2018170800 | | 9/2018 |
| WO | WO2018201655 | | 11/2018 |
| WO | WO2019010680 | | 1/2019 |
| WO | WO2020216762 | | 10/2020 |

* cited by examiner

AEROSOL DELIVERY DEVICE WITH IMPROVED MOUTHPIECES

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of an aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,476 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable and/or replaceable components.

BRIEF SUMMARY

In various implementations, the present disclosure relates to aerosol delivery devices for use with removable and replaceable cartridges (i.e., consumables), where the devices include a removable mouthpiece. The mouthpiece may be removable for cleaning and reuse or interchangeable for customization purposes. The present disclosure includes, without limitation, the following example implementations.

Embodiment 1: An aerosol delivery device comprising a holder having a main body defining a proximal end and a distal end, where the main body further defines a receiving chamber configured to receive a removable cartridge and a first aerosol passageway that extends through at least a portion of the main body; a removable mouthpiece including a first end and a longitudinally opposed second end with a second aerosol passageway extending longitudinally therebetween, where the first end is configured to engage with a user's mouth and the second end is coupleable to the proximal end of the holder; and a collar disposed between the holder and the mouthpiece, where the collar comprises a first end configured to sealingly engage the proximal end of the holder, a second end configured to sealingly engage the second end of the mouthpiece, and a first channel extending therethrough that is configured to fluidly couple the first and second aerosol passageways. The collar may include a second channel extending therethrough. The second channel configured for access to a charging port. In some embodiments, the removable cartridge comprises an ignitable heat source and a substrate portion that includes a substrate material having an aerosol precursor composition configured to form an aerosol upon application of heat thereto.

Embodiment 2: The aerosol delivery device of the preceding embodiment, wherein the collar further comprises a base portion defining an opening in fluid communication with the first channel and having a first sealing mechanism disposed about an exterior surface thereof, the base portion sized and shaped to engage an opening in the proximal end of the holder; and a body portion defining an opening in fluid communication with the first channel and having a second sealing mechanism disposed about an exterior surface thereof, the body portion sized and shaped to engage a recess disposed within the second end of the mouthpiece.

Embodiment 3: The aerosol delivery device of any of Embodiments 1 and 2, or any combination thereof, wherein the base portion is disposed within the proximal end of the holder. In some cases, the base portion is fully disposed within the holder so as to not be visible when the device is assembled.

Embodiment 4: The aerosol delivery device of any of Embodiments 1 to 3, or any combination thereof, wherein the base portion is coupled to the holder via at least one fastener.

Embodiment 5: The aerosol delivery device of any of Embodiments 1 to 4, or any combination thereof, further comprising an inner housing configured to secure one or more components therein, wherein the base portion is secured to the inner housing via at least one fastener.

Embodiment 6: The aerosol delivery device of any of Embodiments 1 to 5, or any combination thereof, wherein the body portion is disposed within the recess of the mouthpiece. In some cases, the body portion is fully disposed within the mouthpiece so as to not be visible when the device is assembled.

Embodiment 7: The aerosol delivery device of any of Embodiments 1 to 6, or any combination thereof, wherein the first sealing mechanism comprises an O-ring disposed within a groove defined by the exterior surface of the base portion.

Embodiment 8: The aerosol delivery device of any of Embodiments 1 to 7, or any combination thereof, wherein the second sealing mechanism comprises at least one O-ring disposed within one or more grooves defined by the exterior surface of the body portion.

Embodiment 9: The aerosol delivery device of any of Embodiments 1 to 8, or any combination thereof, further comprising an actuator assembly coupled to the holder and configured to eject the removable cartridge therefrom.

Embodiment 10: The aerosol delivery device of any of Embodiments 1 to 9, or any combination thereof, further comprising a power source disposed within the main body.

Embodiment 11: The aerosol delivery device of any of Embodiments 1 to 10, or any combination thereof, further comprising an inner housing disposed within the main body of the holder; and a printed circuit board in electrical communication with the power source and comprising a controller, wherein the inner housing is configured to receive the power source and the printed circuit board.

Embodiment 12: The aerosol delivery device of any of Embodiments 1 to 11, or any combination thereof, wherein the printed circuit board further comprises a charging port and the printed circuit board is oriented within the inner housing so that the charging port is disposed at the proximal end of the holder.

Embodiment 13: The aerosol delivery device of any of Embodiments 1 to 12, or any combination thereof, wherein the collar further defines a second channel extending therethrough, the second channel configured to at least partially house or receive the charging port so that the charging port is accessible after removal of the mouthpiece.

Embodiment 14: The aerosol delivery device of any of Embodiments 1 to 13, or any combination thereof, wherein the collar further comprises a base portion defining an opening in fluid communication with the first channel, the base portion sized and shaped to engage an opening in the proximal end of the holder; and a body portion defining an opening in fluid communication with the first channel and having a sealing mechanism disposed about an exterior surface thereof, the body portion sized and shaped to engage a recess disposed within the second end of the mouthpiece.

Embodiment 15: The aerosol delivery device of any of Embodiments 1 to 14, or any combination thereof, wherein the base portion is configured to engage the opening in the proximal end of the holder via at least one of complementary-threaded surfaces for a screw-type engagement, a press-fit engagement, a snap-fit engagement, or a magnetic engagement.

Embodiment 16: The aerosol delivery device of any of Embodiments 1 to 15, or any combination thereof, wherein the sealing mechanism comprises at least one O-ring disposed within one or more grooves defined by the exterior surface of the body portion.

Embodiment 17: The aerosol delivery device of any of Embodiments 1 to 16, or any combination thereof, further comprising an inner housing disposed within the main body of the holder and configured to secure one or more components therein, wherein the inner housing further defines at least a portion of the first aerosol passageway and the base portion of the collar includes a stem extending distally therefrom and configured to engage the at least a portion of the first aerosol passageway in the inner housing.

Embodiment 18: An aerosol delivery device comprising a holder comprising a main body defining a proximal end and a distal end, the main body further defining a receiving chamber configured to receive a removable cartridge and a first aerosol passageway that extends through at least a portion of the main body and a removable mouthpiece comprising a hollow body including a first end and a longitudinally opposed second end with a stem disposed within the hollow body and extending from the first end to the second end, the stem defining a second aerosol passageway extending therethrough, wherein the first end is configured to engage with a user's mouth and the second end is configured to engage the proximal end of the holder. In some embodiments, the removable cartridge comprises an ignitable heat source and a substrate portion that includes a substrate material having an aerosol precursor composition configured to form an aerosol upon application of heat thereto. In some embodiments, a central axis of the stem is offset from a central axis of the mouthpiece.

Embodiment 19: The aerosol delivery device of the preceding embodiment, wherein the longitudinally opposed second end is configured to engage an opening in the proximal end of the holder via at least one of complementary-threaded surfaces for a screw-type engagement, a press-fit engagement, a snap-fit engagement, or a magnetic engagement.

Embodiment 20: The aerosol delivery device of any of Embodiments 18 and 19, or any combination thereof, wherein the stem is sealingly engaged with the first aerosol passageway in the holder.

Embodiment 21: The aerosol delivery device of any of Embodiments 18 to 20, or any combination thereof, wherein the stem includes a sealing mechanism disposed about an exterior surface thereof.

Embodiment 22: The aerosol delivery device of any of Embodiments 18 to 21, or any combination thereof, wherein the sealing mechanism comprises an O-ring disposed within a groove defined by the exterior surface of the stem.

Embodiment 23: The aerosol delivery device of any of Embodiments 18 to 22, or any combination thereof, further comprising an inner housing disposed within the main body of the holder and defining at least a portion of the first aerosol passageway, wherein the stem is partially disposed within the inner housing and in fluid communication with the at least a portion of the first aerosol passageway in the inner housing.

Embodiment 24: The aerosol delivery device of any of Embodiments 18 to 23, or any combination thereof, further comprising an inner housing disposed within the main body of the holder and comprising a retention structure disposed on a proximal end thereof, wherein the longitudinally opposed second end of the mouthpiece defines a mating retention structure configured to engage the retention structure on the inner housing.

Embodiment 25: The aerosol delivery device of any of Embodiments 18 to 24, or any combination thereof, wherein the mouthpiece further comprises an insert removably disposed within a recess formed within the first end of the mouthpiece.

Embodiment 26: The aerosol delivery device of any of Embodiments 18 to 25, or any combination thereof, wherein the insert is configured to reduce an aerosol outlet in the mouthpiece.

Embodiment 27: An aerosol delivery device comprising a holder having a main body defining a proximal end and a distal end, the main body further defining a receiving chamber configured to receive a removable cartridge and a first aerosol passageway that extends through at least a portion of the main body; a mouthpiece including a first end and a longitudinally opposed second end with a second aerosol passageway extending longitudinally therebetween, wherein the first end is configured to engage with a user's mouth and the second end is configured to engage the proximal end of the holder; and a removable flow restrictor comprising an outer surface configured to be removably secured within the holder and an inner surface defining a third aerosol passageway.

Embodiment 28: The aerosol delivery device of the preceding embodiment, wherein the flow restrictor is configured to be at least partially disposed within the first aerosol passageway, the second aerosol passageway, or both.

Embodiment 29: The aerosol delivery device of any of Embodiments 27 and 28, or any combination thereof, wherein the removable flow restrictor is configured to sealingly engage the first aerosol passageway, the second aerosol passageway, or both.

Embodiment 30: The aerosol delivery device of any of Embodiments 27 to 29, or any combination thereof, wherein the flow restrictor comprises a body portion and a lip portion disposed at a proximal end thereof, the lip portion configured to engage the proximal end of the main body.

Embodiment 31: The aerosol delivery device of any of Embodiments 27 to 30, or any combination thereof, wherein the body portion is disposed within the first aerosol passageway.

Embodiment 32: The aerosol delivery device of any of Embodiments 27 to 31, or any combination thereof, wherein the lip portion is disposed within the second aerosol passageway.

Embodiment 33: The aerosol delivery device of any of Embodiments 27 to 32, or any combination thereof, wherein the removable flow restrictor is configured to provide fluid communication between the first aerosol passageway and the second aerosol passageway.

Embodiment 34: The aerosol delivery device of any of Embodiments 27 to 33, or any combination thereof, wherein the inner surface of the flow restrictor is tapered along a length thereof.

Embodiment 35: The aerosol delivery device of any of Embodiments 27 to 34, or any combination thereof, wherein the inner surface of the removable flow restrictor defines an orifice configured to provide a pressure drop between the first aerosol passageway and the second aerosol passageway.

Embodiment 36: The aerosol delivery device of any of Embodiments 27 to 35, or any combination thereof, wherein the mouthpiece comprises a body portion configured to engage the proximal end of the main body and a hollow stem extending therethrough, the stem at least partially defining the second aerosol passageway and configured to receive the flow restrictor therein.

Embodiment 37: The aerosol delivery device of any of Embodiments 27 to 36, or any combination thereof, further comprising a plurality of interchangeable removable flow restrictors. The flow restrictors may comprise different sizes and shapes to, for example, allow a user to customize their experience by optimizing a vapor flow rate, pressure drop, flavoring, or other sensation.

Embodiment 38: The aerosol delivery device of any of Embodiments 27 to 37, or any combination thereof, further comprising an access door assembly sealingly coupled to the main body and defining the receiving chamber, where the access door assembly is movable between an open configuration providing access to the receiving chamber for loading the removable cartridge therein and a closed configuration securing the cartridge in fluid communication with first aerosol passageway.

Embodiment 39: The aerosol delivery device of any of Embodiments 27 to 38, or any combination thereof, wherein the access door assembly is pivotably coupled to the holder.

Embodiment 40: The aerosol delivery device of any of Embodiments 1 to 39, or any combination thereof, further comprising a latching mechanism configured to secure the access door assembly in the closed configuration.

Embodiment 41: The aerosol delivery device of any of Embodiments 27 to 40, or any combination thereof, further comprising an actuator assembly configured to release the access door assembly from the closed configuration. For example, the access door assembly is biased into an open configuration and the actuator is a spring-loaded slide button that includes a latching edge that engages an inner surface of the holder to maintain the access door in the closed configuration until slid forward.

Embodiment 42: The aerosol delivery device of any of Embodiments 27 to 41, or any combination thereof, further comprising a power source disposed within the main body and a pair of ignitor contacts in electrical communication with the power supply, disposed proximate the distal end of the main body, and configured to engage an ignitable heat source portion of the removable cartridge when the removable cartridge is secured within the receiving chamber.

Embodiment 43: The aerosol delivery device of any of Embodiments 27 to 42, or any combination thereof, wherein the holder further comprises a printed circuit board disposed therein and in electrical communication with the power source and comprising a charging port, wherein the printed circuit board is oriented so that the charging port is disposed at the distal end of the main body.

Embodiment 44: The aerosol delivery device of any of Embodiments 27 to 43, or any combination thereof, further comprising a button assembly configured to deliver electrical energy to the ignitable heat source when actuated.

Embodiment 45: The aerosol delivery device of any of Embodiments 27 to 44, or any combination thereof, wherein the removable cartridge comprises an ignitable heat source and a substrate portion that includes a substrate material having an aerosol precursor composition configured to form an aerosol upon application of heat thereto.

Embodiment 46: The aerosol delivery device of any of Embodiments 27 to 45, or any combination thereof, wherein the access door assembly includes an insert disposed therein and configured to receive the cartridge and provide thermal insulation thereto.

Embodiment 47: An aerosol delivery device comprising a holder having a main body defining a proximal end and a distal end, where the main body further defines a receiving chamber configured to receive a removable cartridge (e.g., one comprising an ignitable heat source and a substrate portion that includes a substrate material having an aerosol precursor composition configured to form an aerosol upon application of heat thereto) and a first aerosol passageway that extends through at least a portion of the main body; a mouthpiece including a first end and a longitudinally opposed second end with a second aerosol passageway extending longitudinally therebetween, wherein the first end is configured to engage with a user's mouth and the second end is configured to engage the proximal end of the holder; and an inner housing disposed within the main body of the holder and defining a first port disposed proximate a first end of the inner housing, a second port disposed proximate a second end of the inner housing, and a first channel disposed in an outer surface of the inner housing and fluidly coupling the first port and the second port to form a third aerosol passageway, wherein the first port is in fluid communication with the first aerosol passageway, the second port is in fluid communication with the second aerosol passageway. The first, second, and third aerosol passageways are configured to form a continuous vapor path from the distal end of the main body to the first end of the mouthpiece for passing an aerosol generated from the removable cartridge to a user.

Embodiment 48: The aerosol delivery device of the preceding embodiment, wherein the inner housing defines a second channel disposed in the outer surface thereof and oriented opposite of the first channel.

Embodiment 49: The aerosol delivery device of any of Embodiments 47 and 48, or any combination thereof, wherein the first and second channels merge at the first port and the second port.

Embodiment 50: The aerosol delivery device of any of Embodiments 47 to 49, or any combination thereof, wherein the inner housing is disposed within the main body so that an inner surface of the holder encloses the first and second channels.

Embodiment 51: The aerosol delivery device of any of Embodiments 47 to 50, or any combination thereof, further comprising an actuator assembly coupled to the holder and configured to eject the removable cartridge therefrom.

Embodiment 52: The aerosol delivery device of any of Embodiments 47 to 51, or any combination thereof, wherein the actuator assembly comprises a slider body slidably disposed within the main body of the holder and configured to sealingly engage the first end of the inner housing, the slider body defining a receptacle configured to at least partially receive the removable cartridge and an inner stem engageable with one end of the removable cartridge and defining a fourth aerosol passageway therethrough configured to pass the aerosol generated from the removable cartridge, wherein the first, second, third, and fourth aerosol passageways are configured to define the continuous vapor path from the distal end of the main body to the first end of the mouthpiece.

Embodiment 53: The aerosol delivery device of any of Embodiments 47 to 52, or any combination thereof, further comprising a collar disposed between the holder and the mouthpiece, the collar comprising a first end configured to sealingly engage the proximal end of the holder, a second end configured to sealingly engage the second end of the mouthpiece, and defining a first channel therethrough fluidly coupling the third aerosol passageway and the second aerosol passageway.

Embodiment 54: The aerosol delivery device of any of Embodiments 47 to 53, or any combination thereof, wherein the mouthpiece is removable Embodiment 55: The aerosol delivery device of any of Embodiments 47 to 54, or any combination thereof, further comprising a power source disposed within the main body; and a printed circuit board in electrical communication with the power source and comprising a controller, wherein the inner housing defines a cavity configured to receive the power source and the printed circuit board therein. In some implementations, the vapor splits in the inner housing so as to travel around the cavity and any electronics disposed therein.

Embodiment 56: The aerosol delivery device of any of Embodiments 48 to 55, or any combination thereof, wherein the printed circuit board further comprises a charging port and the printed circuit board is oriented within the inner housing so that the charging port is disposed at the proximal end of the holder.

Embodiment 57: An aerosol delivery device comprising a holder having a main body defining a proximal end and a distal end, the main body further defining a receiving chamber configured to receive a removable cartridge and a first aerosol passageway that extends through at least a portion of the main body, and a mouthpiece assembly comprising a mouthpiece including a first end configured to engage with a user's mouth and a longitudinally opposed second end configured to engage the proximal end of the holder with a second aerosol passageway extending between the first and second ends, wherein a central longitudinal axis of the second aerosol passageway is offset from a central longitudinal axis of the first aerosol passageway and the first and second aerosol passageways define a unitary offset vapor path from the distal end of the main body to the first end of the mouthpiece for passing an aerosol generated from the removable cartridge to a user.

Embodiment 58: The aerosol delivery device of the preceding embodiment, wherein the mouthpiece assembly further comprises an insert at least partially disposed within a recess formed within the second end of the mouthpiece and defining a third aerosol passageway configured to fluidly couple the first aerosol passageway and the second aerosol passageway.

Embodiment 59: The aerosol delivery device of any of Embodiments 57 and 58, or any combination thereof, further comprising an access door assembly sealingly coupled to the main body and defining the receiving chamber, wherein the access door assembly is movable between an open configuration providing access to the receiving chamber for loading the removable cartridge therein and a closed configuration securing the cartridge in fluid communication with the first aerosol passageway.

Embodiment 60: The aerosol delivery device of any of Embodiments 57 to 59, or any combination thereof, wherein the access door assembly is pivotably coupled to the holder.

Embodiment 61: An aerosol delivery device comprising a holder having a main body defining a proximal end and a distal end, the main body further defining a receiving chamber configured to receive a removable cartridge and a first aerosol passageway that extends through at least a portion of the main body and a removable mouthpiece comprising a hollow body including a first end and a longitudinally opposed second end with an offset stem disposed within the hollow body and extending from the first end to the second end, the offset stem defining a second aerosol passageway extending therethrough, wherein the first end is configured to engage with a user's mouth, the second end is configured to engage the proximal end of the holder, and the offset stem is sealingly engaged with the first aerosol passageway in the holder to define a linear vapor pathway.

Embodiment 62: An aerosol delivery device comprising a holder having an upper body portion and a lower body portion, each defining a proximal end and a distal end, wherein: the lower body portion further defines a receiving chamber disposed in the proximal end thereof and configured to receive a removable cartridge comprising an ignitable heat source and a substrate portion that includes a substrate material having an aerosol precursor composition configured to form an aerosol upon application of heat thereto and the upper body portion further defines a first aerosol passageway extending therethrough and comprises a sliding actuator assembly slidably disposed within the first aerosol passageway, the sliding actuator configured to eject the removable cartridge from the lower body portion, wherein the upper body portion and the lower body portion are coupled together so as to be movable between an open configuration and a closed configuration; and a mouthpiece including a first end and a longitudinally opposed second end with a second aerosol passageway extending longitudinally therebetween, wherein the first end is configured to engage with a user's mouth and the second end is configured to engage the proximal end of the upper body portion, wherein the first and second aerosol passageways are configured to define a linear vapor path from the distal end of the lower body portion to the first end of the mouthpiece for passing the aerosol generated from the removable cartridge to a user when in the closed configuration.

Embodiment 63: The aerosol delivery device of the preceding embodiment, wherein the sliding actuator assembly comprises a tubular body defining a third aerosol passageway and configured to slide along a portion of the upper body portion in a first direction and a second direction, wherein the tubular body comprises a longitudinally oriented baffle extending inwardly from an interior wall thereof, where the baffle divides the aerosol traveling through the third aerosol passageway portion of the linear vapor path.

Embodiment 64: The aerosol delivery device of any of Embodiments 62 and 63, or any combination thereof, wherein the sliding actuator assembly comprises a tubular body defining a third aerosol passageway and configured to slide along a portion of the upper body portion in a first direction and a second direction; a first protrusion extending from an outer surface of the tubular body and configured to extend through an opening in a wall of the upper body portion to provide for moving the tubular body in the first and second directions; and a second protrusion extending from a distal end of the tubular body and configured to engage the removable cartridge so as to advance the removable cartridge through the distal end of the lower body portion when the tubular body is moved in the first or second direction.

Embodiment 65: The aerosol delivery device of any of Embodiments 62 to 64, or any combination thereof, wherein one or more portions of the first protrusion, the second protrusion, or both extend into the third aerosol passageway defined by the tubular body so that the aerosol generated by the cartridge is split by the one or more portions when traveling through the tubular body.

Embodiment 66: The aerosol delivery device of any of Embodiments 62 to 65, or any combination thereof, wherein the sliding actuator further comprises a sealing arrangement for sealingly engaging an internal surface of the upper body portion.

Embodiment 67: The aerosol delivery device of any of Embodiments 62 to 66, or any combination thereof, further comprising a locking mechanism disposed on at least one of the lower body portion or the upper body portion and configured to maintain the device in the closed configuration.

Embodiment 68: The aerosol delivery device of any of Embodiments 62 to 67, or any combination thereof, further comprising a sealing mechanism disposed between the proximal end of the lower body portion and the distal end of the upper body portion and configured to seal the receiving chamber with the first aerosol passageway so as to prevent leakage from the vapor path.

Embodiment 69: The aerosol delivery device of any of Embodiments 62 to 68, or any combination thereof, wherein the lower body portion comprises a window disposed therein and configured to provide a view of at least a portion of the removable cartridge.

Embodiment 70: The aerosol delivery device of any of Embodiments 62 to 69, or any combination thereof, wherein the lower body portion is rotatable relative to the upper body portion to expose the receiving chamber and load the removable cartridge therein.

Embodiment 71: An aerosol delivery device comprising a holder having a main body defining a proximal end and a distal end, where the main body further defines a receiving chamber configured to receive a removable cartridge and a first aerosol passageway that extends through at least a portion of the main body and a removable mouthpiece that comprises a first portion defined by a first end and a longitudinally opposed second end and a second portion that extends from the longitudinally opposed second end, wherein the first and second portions define a second aerosol passageway extending therethrough, the first end of the first portion is configured to engage with a user's mouth, the second end of the first portion is configured to engage with the proximal end of the holder, and the second portion is configured to extend within the holder. In some embodiments, the removable cartridge comprises an ignitable heat source and a substrate portion that includes a substrate material having an aerosol precursor composition configured to form an aerosol upon application of heat thereto Embodiment 72: The aerosol delivery device of the preceding embodiment, wherein the second end of the first portion is configured to engage the opening in the proximal end of the holder via at least one of complementary-threaded surfaces for a screw-type engagement, a press-fit engagement, a snap-fit engagement, or a magnetic engagement.

Embodiment 73: The aerosol delivery device of any of Embodiments 71 and 72, or any combination thereof, wherein the second portion of the mouthpiece is sealingly engaged with the first aerosol passageway in the holder.

Embodiment 74: The aerosol delivery device of any of Embodiments 71 to 73, or any combination thereof, wherein the second portion of the mouthpiece includes a sealing mechanism disposed about an exterior surface thereof.

Embodiment 75: The aerosol delivery device of any of Embodiments 71 to 74, or any combination thereof, wherein the sealing mechanism comprises an O-ring disposed within a groove defined by the exterior surface of the second portion of the mouthpiece.

Embodiment 76: The aerosol delivery device of any of Embodiments 71 to 75, or any combination thereof further comprising an actuator assembly at least partially disposed within the main body of the holder and configured to eject the removable cartridge therefrom.

Embodiment 77: The aerosol delivery device of any of Embodiments 71 to 76, or any combination thereof, wherein the actuator assembly comprises a sliding body that defines at least a portion of the first aerosol passageway and the second portion of the mouthpiece is slidably disposed within the sliding body and in fluid communication with the at least a portion of the first aerosol passageway in the sliding body.

Embodiment 78: The aerosol delivery device of any of Embodiments 71 to 77, or any combination thereof further comprising an inner housing disposed within the main body of the holder and comprising a first retention structure disposed on a proximal end thereof, wherein the second end of the first portion of the mouthpiece defines a mating retention structure (e.g., a gap or groove disposed about the inner perimeter of the second end) configured to engage the retention structure on the inner housing. In some implementations, the inner housing may include a second retention structure configured to mate with the holder and secure the inner housing therein or the first retention structure may be disposed on the proximal end of the holder.

Embodiment 79: The aerosol delivery device of any of Embodiments 71 to 78, or any combination thereof, wherein a central axis of the second portion of the mouthpiece is offset from a central axis of the first portion of the mouthpiece.

Embodiment 80: An aerosol delivery device including a holder comprising a main body defining a proximal end and a distal end, the main body further defining a receiving chamber configured to receive a removable cartridge comprising an aerosol precursor composition configured to form an aerosol upon application of heat thereto and a removable mouthpiece comprising an elongate body portion defined by a first end and a longitudinally opposed second end and defining an aerosol passageway extending therethrough, a first retention mechanism disposed about an exterior surface of the elongate body portion, the first retention mechanism configured to removably secure the second end of the mouthpiece within the holder, and a second retention mechanism disposed within a receptacle defined by the second end of the elongate body member, the second retention mechanism configured to removably secure a portion of the cartridge therein, wherein the first end of the mouthpiece is configured to engage with a user's mouth. In some implementations, the first retention mechanism is located proximate the first end of the elongate body portion.

Embodiment 81: The aerosol delivery device of the preceding embodiment, further comprising an inner housing disposed within the main body of the holder and defining a passageway therethrough configured to receive a portion of the mouthpiece therein.

Embodiment 82: The aerosol delivery device of any of Embodiments 80 and 81, or any combination thereof further comprising a pair of ignitor contacts disposed within the holder and proximate the distal end thereof, wherein the contacts are configured to receive an ignitable heat source portion of the cartridge therebetween.

Embodiment 83: The aerosol delivery device of any of Embodiments 80 to 82, or any combination thereof, wherein the inner housing comprises a stop configured to configured to limit insertion of the mouthpiece so as to operatively engage the ignitable heat source with the ignitor contacts.

Embodiment 84: The aerosol delivery device of any of Embodiments 80 to 83, or any combination thereof, wherein the first retention mechanism is configured to sealingly engage with the passageway in the inner housing.

Embodiment 85: The aerosol delivery device of any of Embodiments 80 to 84, or any combination thereof, wherein the first retention mechanism includes an elastomeric seal disposed about an exterior surface thereof and configured to frictionally engage with the inner housing passageway.

Embodiment 86: The aerosol delivery device of any of Embodiments 80 to 85, or any combination thereof, wherein the second retention mechanism is configured to sealingly engage with a substrate portion of the cartridge.

Embodiment 87: The aerosol delivery device of any of Embodiments 80 to 86, or any combination thereof, wherein the second retention mechanism includes an elastomeric seal disposed about an interior surface thereof and configured to frictionally engage with the cartridge.

Embodiment 88: The aerosol delivery device of any of Embodiments 80 to 87, or any combination thereof further comprising an ignitor push button configured to activate the ignitor contacts thereby igniting the heat source when pressed by a user.

Embodiment 89: The aerosol delivery device of any of Embodiments 80 to 88, or any combination thereof, wherein the ignitor contacts will be deactivated when the ignitor push button is released.

Embodiment 90: The aerosol delivery device of any of Embodiments 80 to 89, or any combination thereof, wherein the ignitor contacts will be deactivated after a set time (e.g., about 2 to 60 seconds, about 5 to 30 seconds, or about 20 seconds), either after the ignitor push button is activated or after it is released.

Embodiment 91: An aerosol delivery device including a holder comprising a main body defining a proximal end and a distal end, the main body further defining a receiving chamber configured to receive a removable cartridge comprising an aerosol precursor composition configured to form an aerosol upon application of heat thereto and a removable mouthpiece configured to engage the proximal end of the holder. The mouthpiece comprises a first portion comprising an elongate body defined by a first end and a longitudinally opposed second end and defining a passageway extending therethrough; a second portion defined by a first end and a longitudinally opposed second end and defining a first aerosol passageway therethrough, wherein the first end of the second portion is configured to engage with a user's mouth and the second end is partially disposed within the passageway of the first portion of the mouthpiece proximate the first end of the first portion; a slider body defined by a first end and a longitudinally opposed second end and defining a second aerosol passageway therethrough, wherein the slider body is slidably disposed within the first portion of the mouthpiece and the first end of the slider body is coupled to the second end of the second portion of the mouthpiece and the second end of the slider body is configured to engage the removable cartridge; an inner tubular body defined by a first end and a longitudinally opposed second end and defining a receptacle comprising a first biasing mechanism disposed therein, the receptacle configured to at least partially receive the slider body, the slider body slidably coupled to the inner tubular body, wherein the second end of the inner tubular body is configured to engage the first portion of the mouthpiece proximate the second end of the first portion and the biasing mechanism is configured to maintain the slider body in a loading configuration; and an outlet guide coupled to the second end of the first portion of the mouthpiece and partially received within the second end of the inner tubular body, wherein the outlet guide defines a cavity configured to sealingly engage and removably secure the removable cartridge therein. The slider body may be configured to slide along a length of the first portion of the mouthpiece in a first direction and a second direction.

Embodiment 92: The aerosol delivery device of any of Embodiments 1 to 91, or any combination thereof, further comprising the removable cartridge. The removable cartridge comprises an ignitable heat source and a substrate portion that includes a substrate material having an aerosol precursor composition configured to form an aerosol upon application of heat thereto.

Embodiment 93: The aerosol delivery device of any of Embodiments 1 to 92, or any combination thereof, wherein the holder comprises a window disposed therein, the window configured to provide a view of at least a portion of the removable cartridge.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1A:
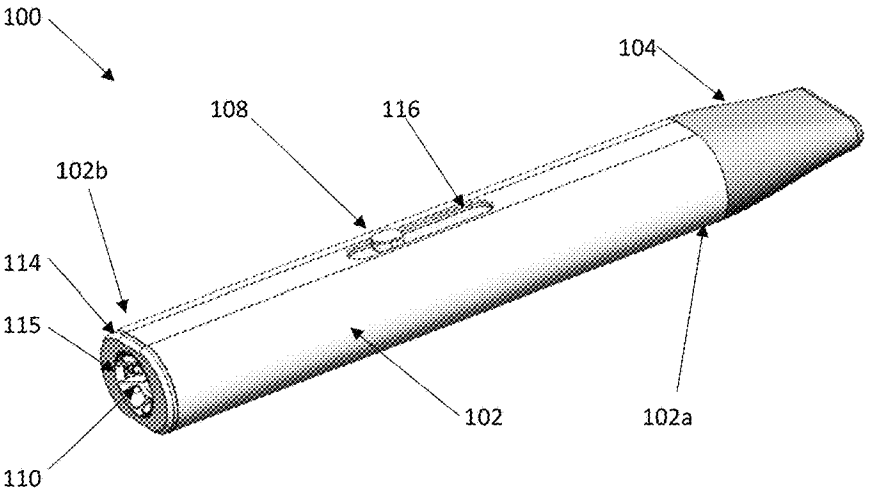
Figure 1B:
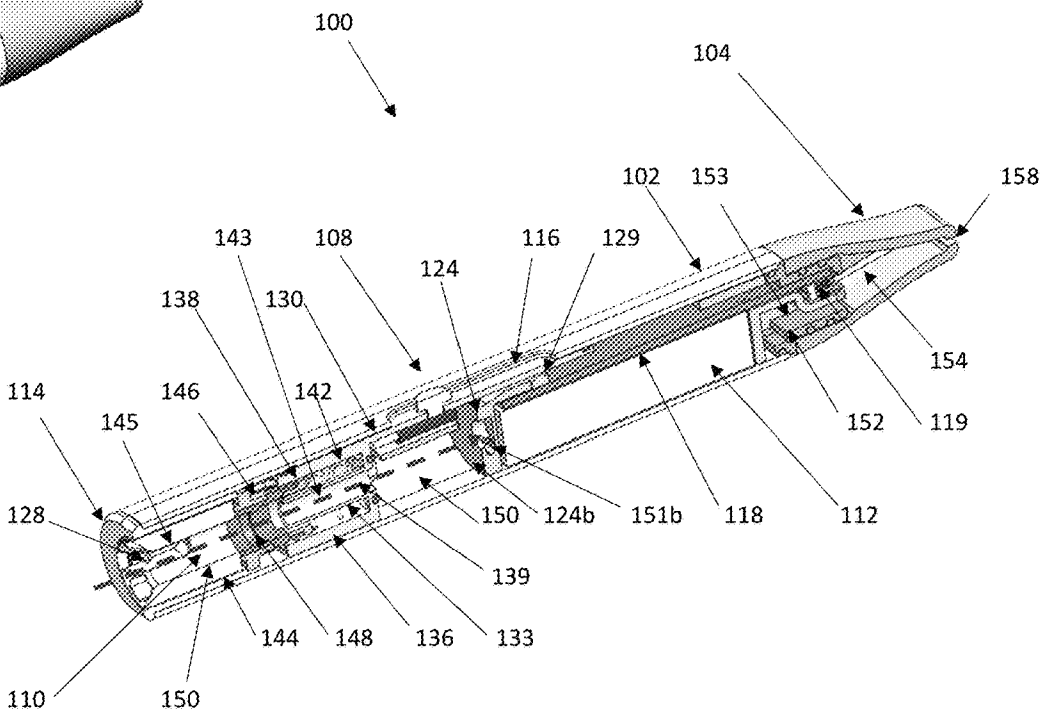
Figure 2:
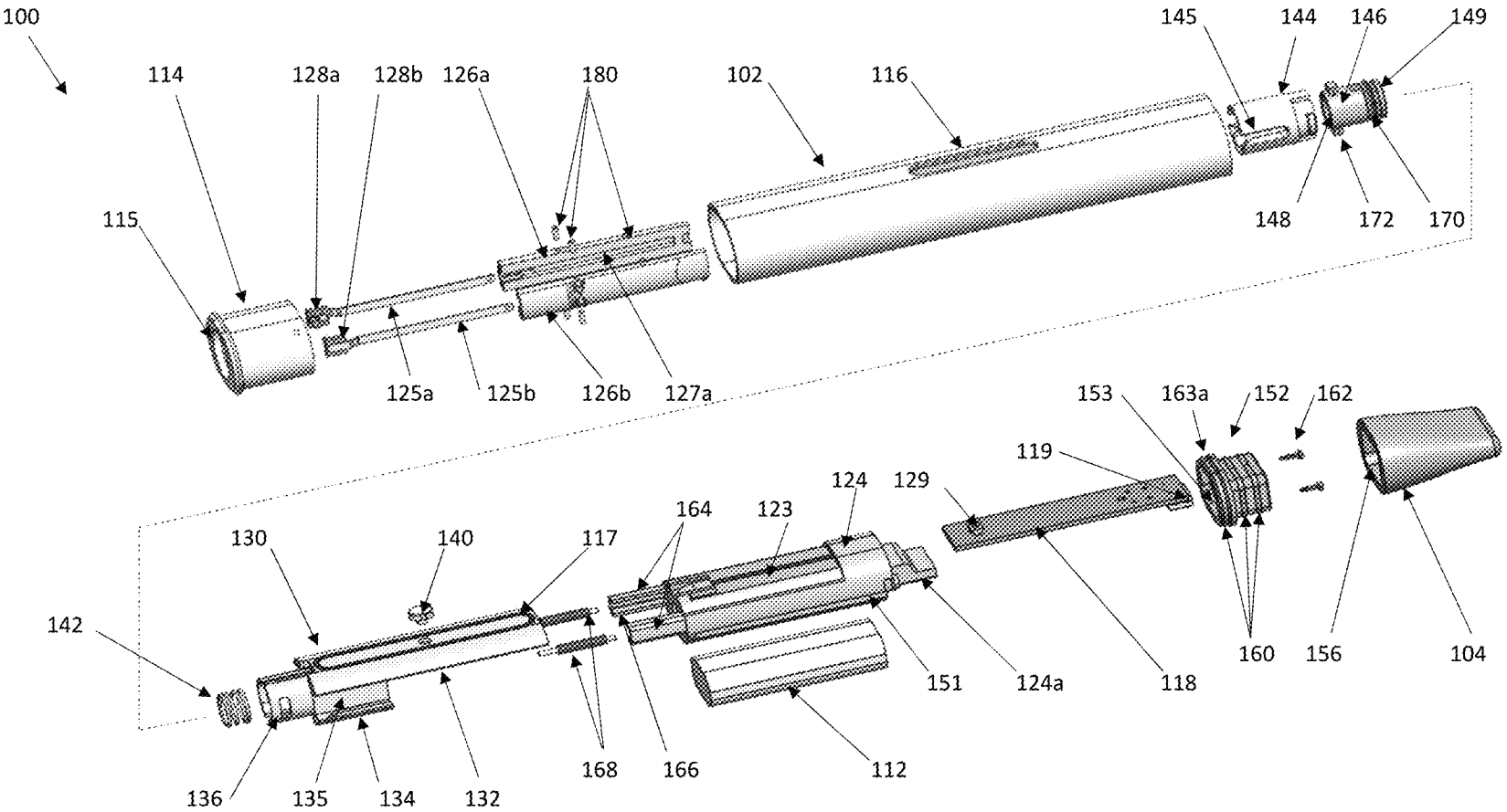
Figure 3A:
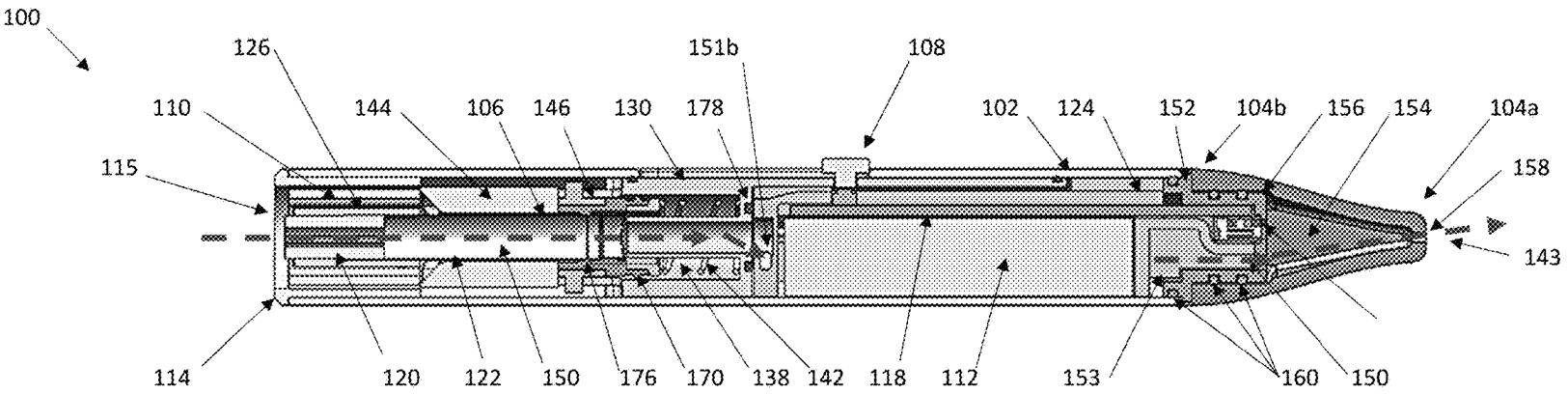
Figure 3B:
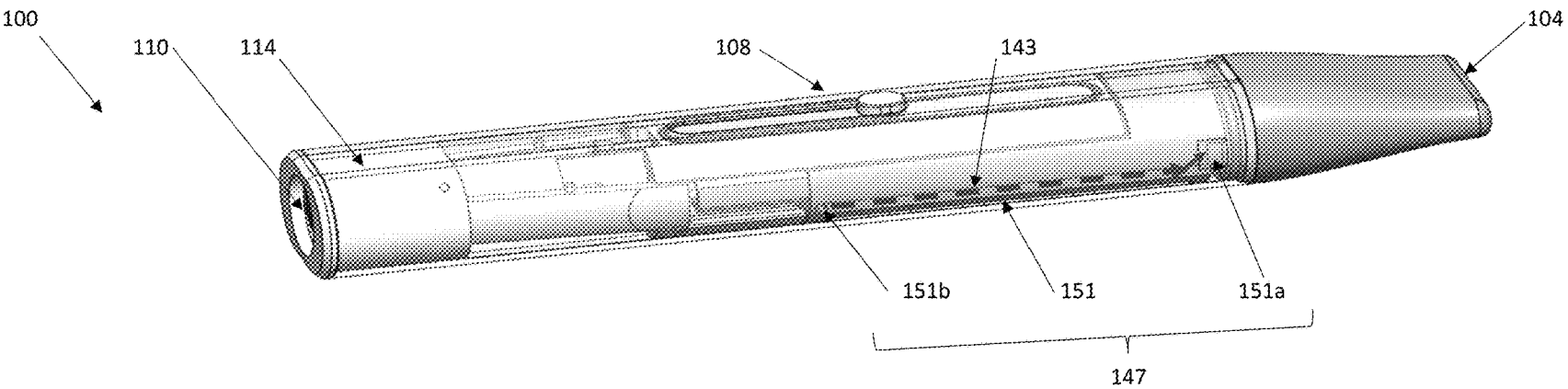
Figure 4B:
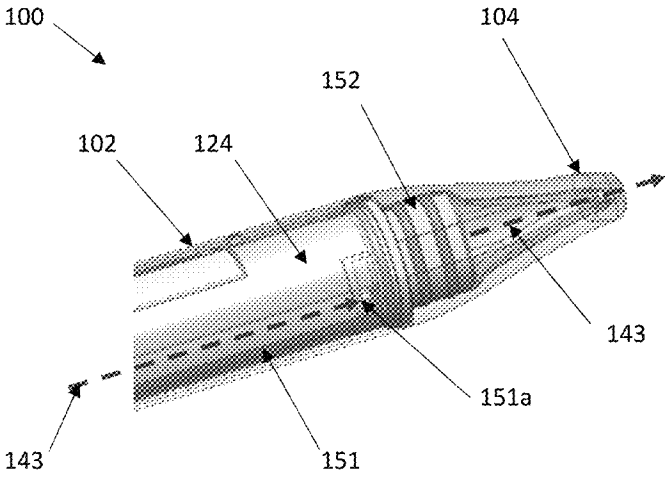
Figure 4A:
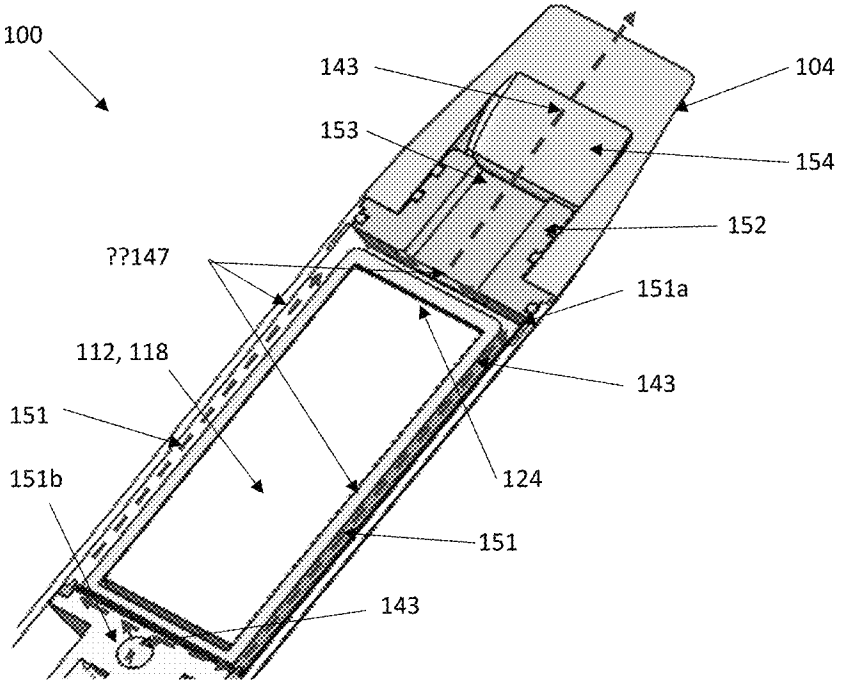
Figure 4C:
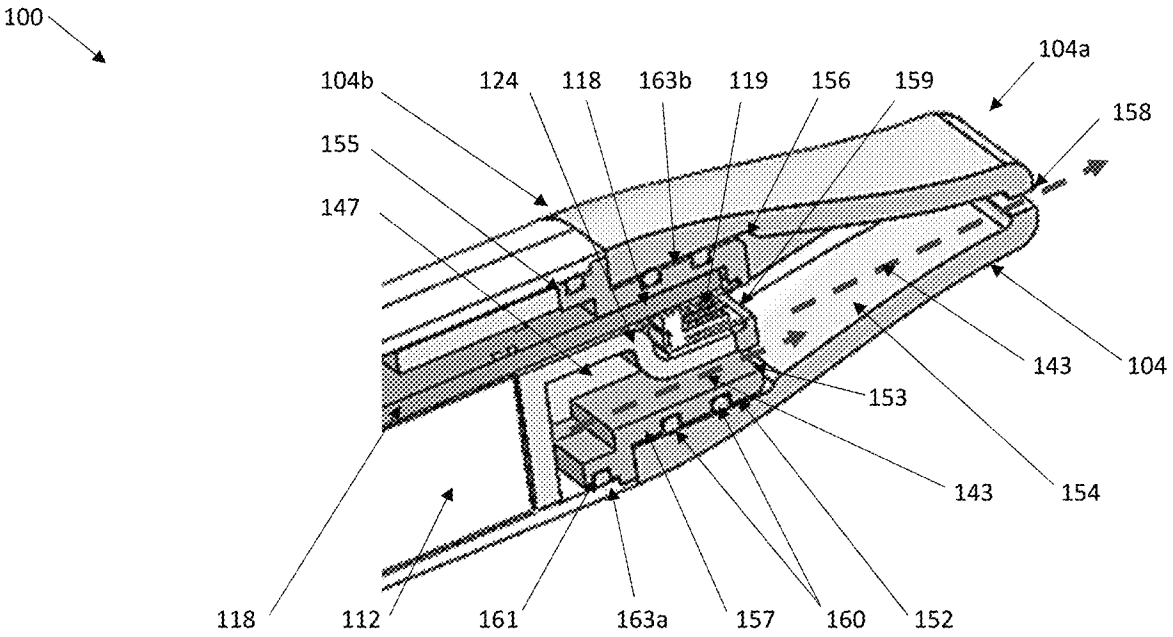
Figure 5:
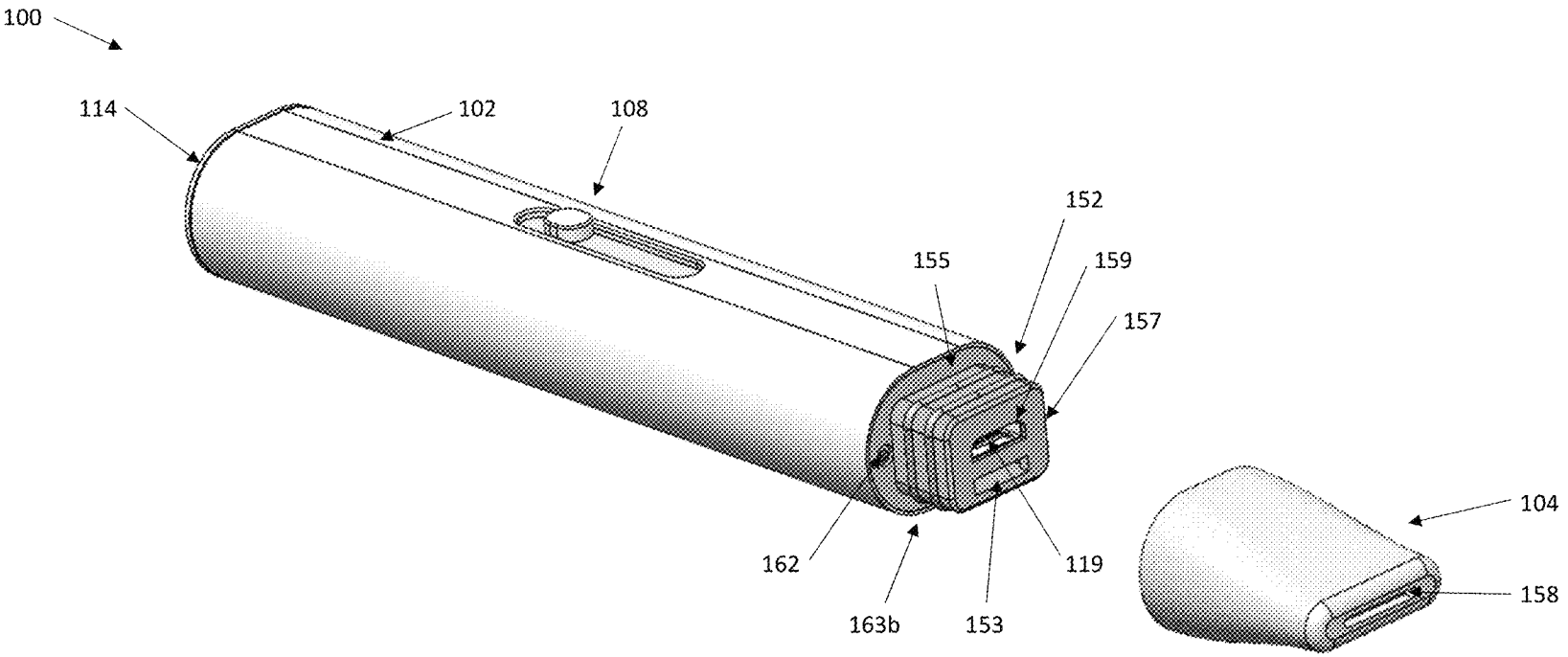
Figure 6B:
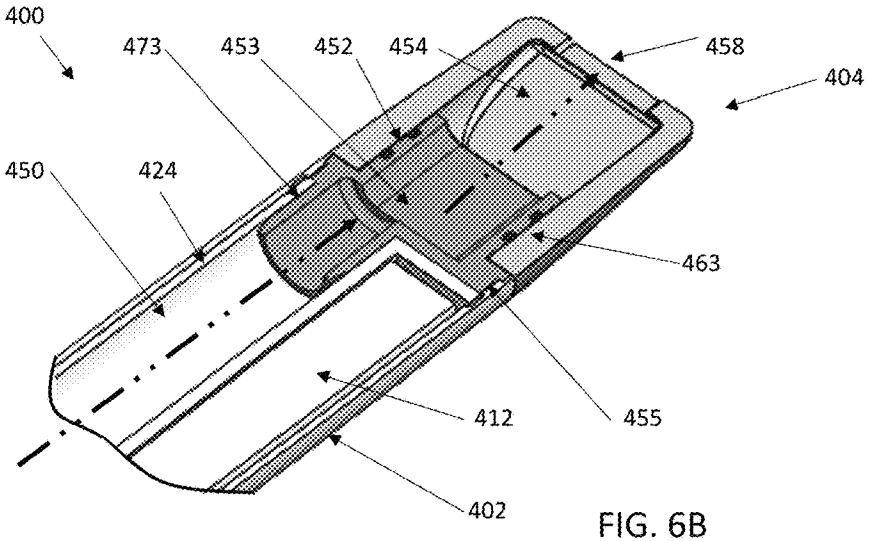
Figure 6A:
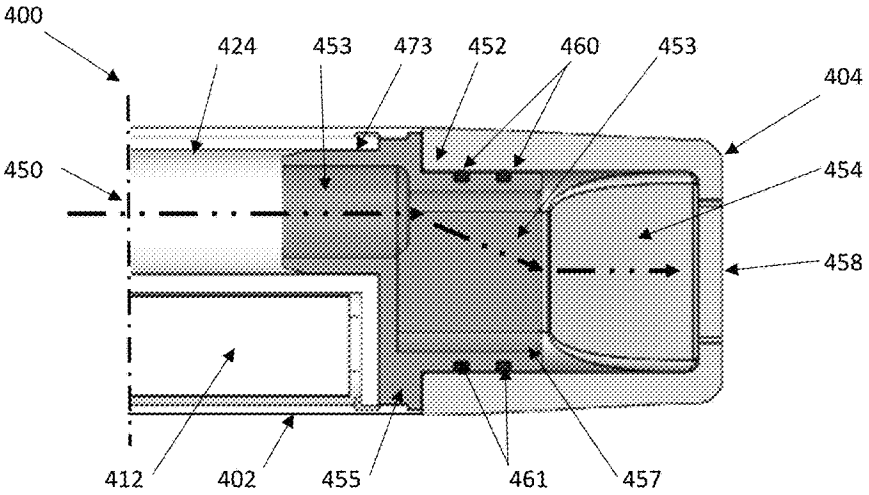
Figure 7B:
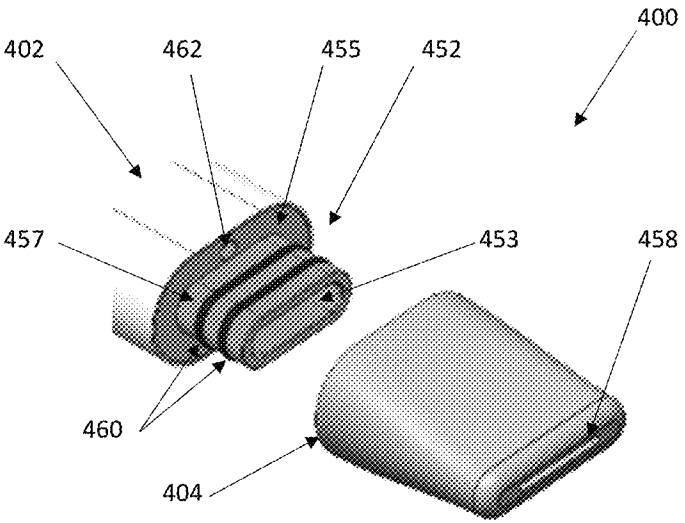
Figure 7A:
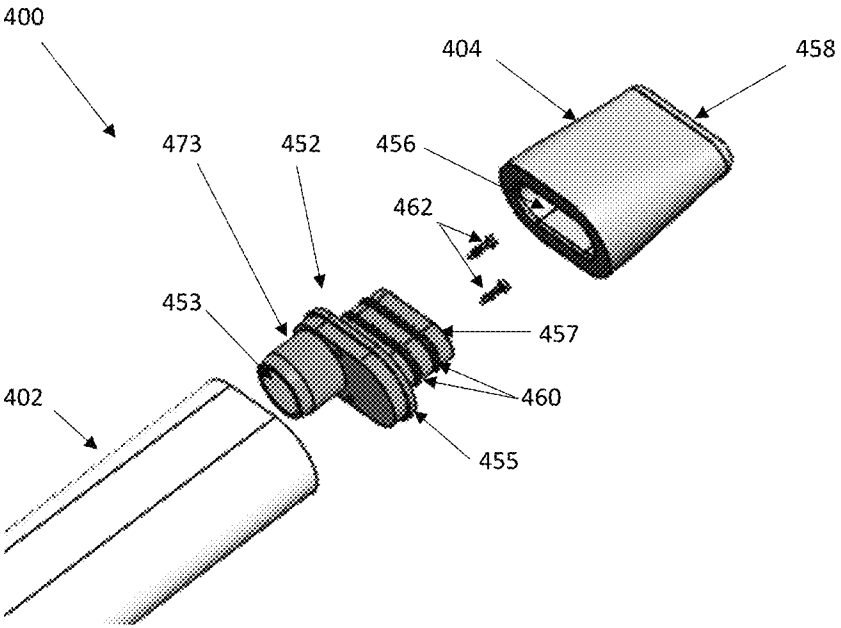
Figure 8B:
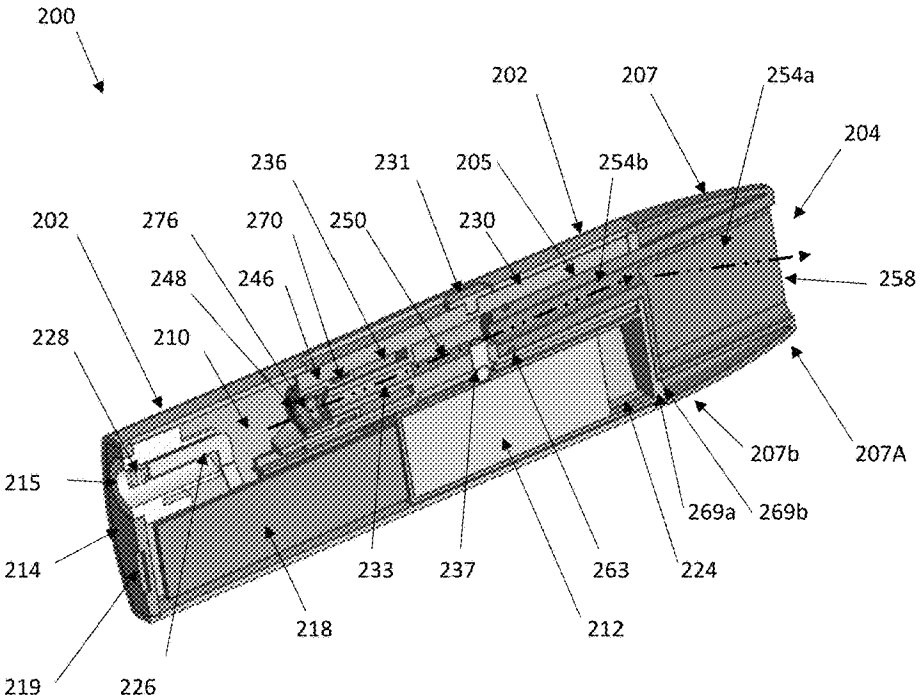
Figure 8A:
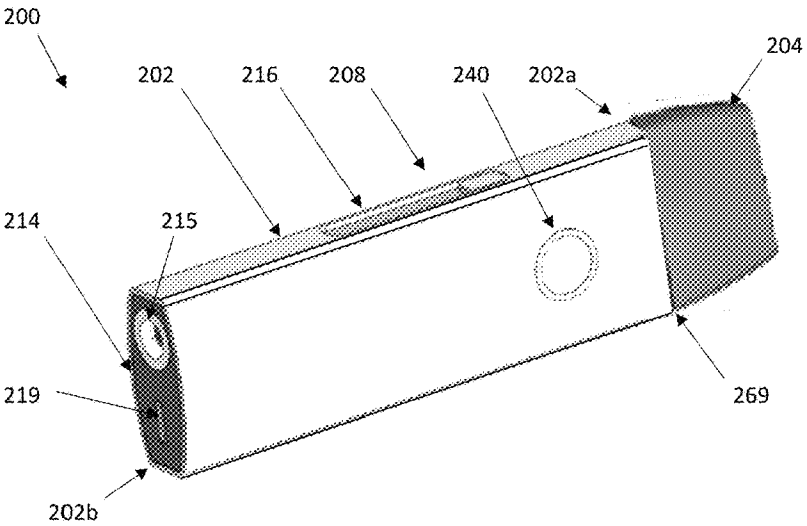
Figure 9:
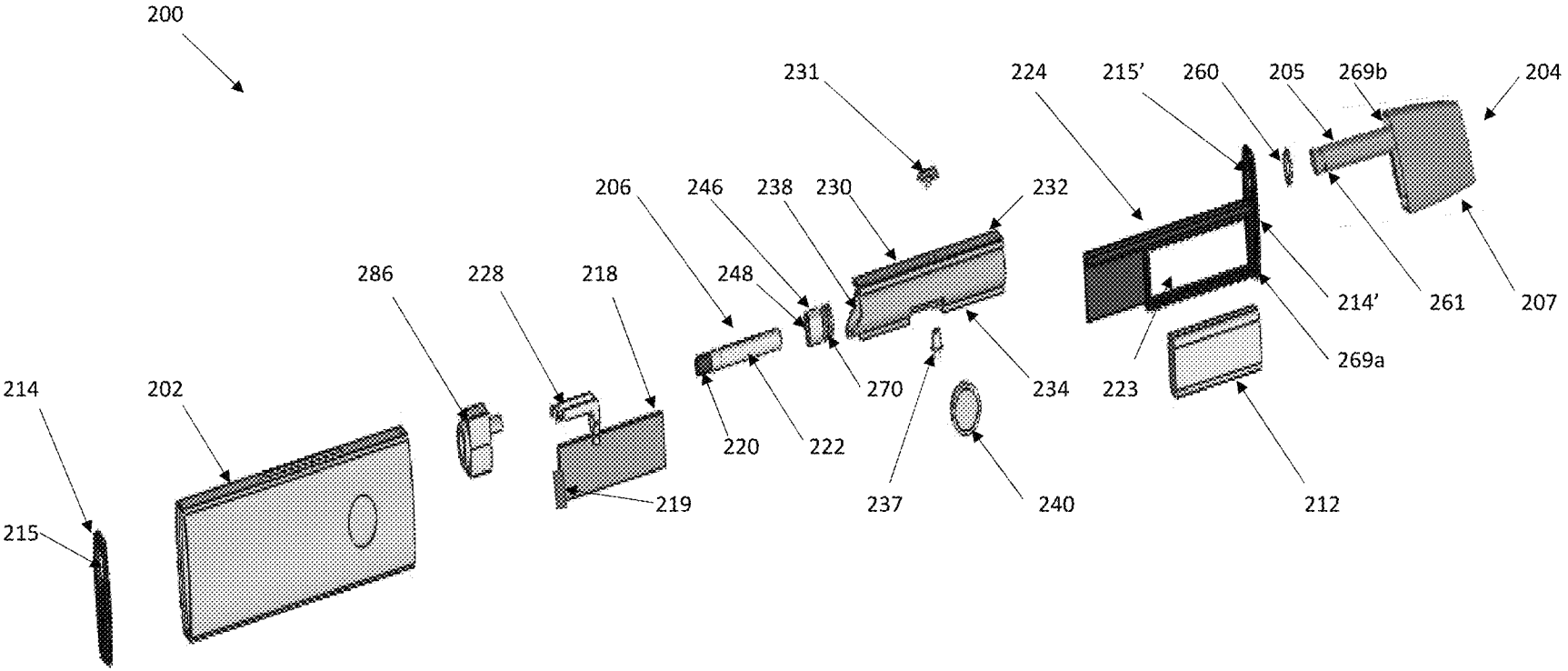
Figure 10:
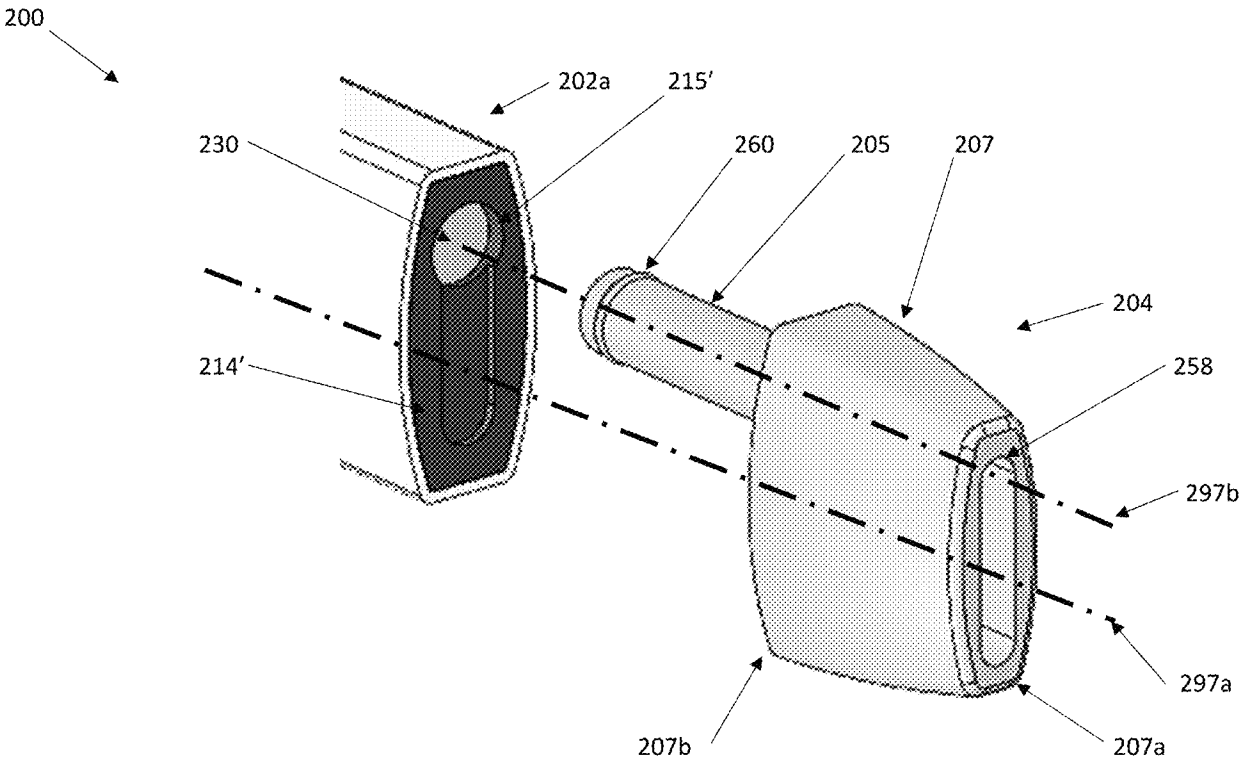
Figure 11B:
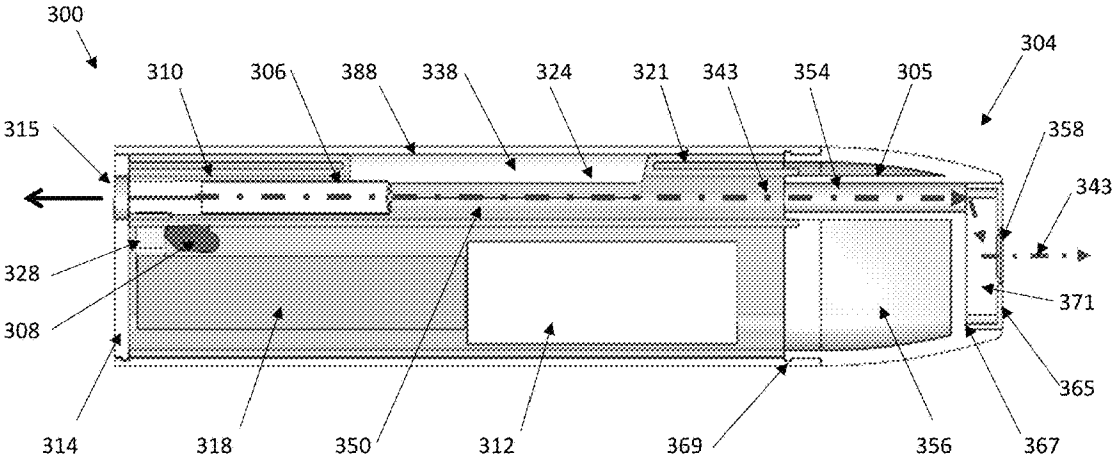
Figure 11A:
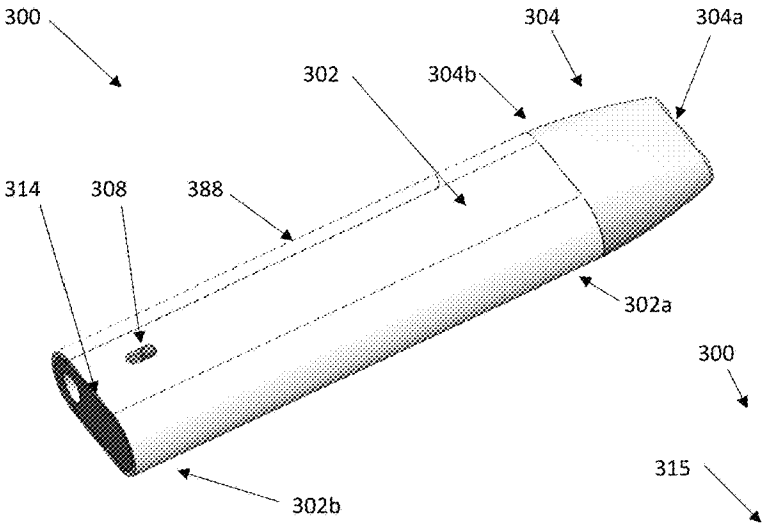
Figure 12:
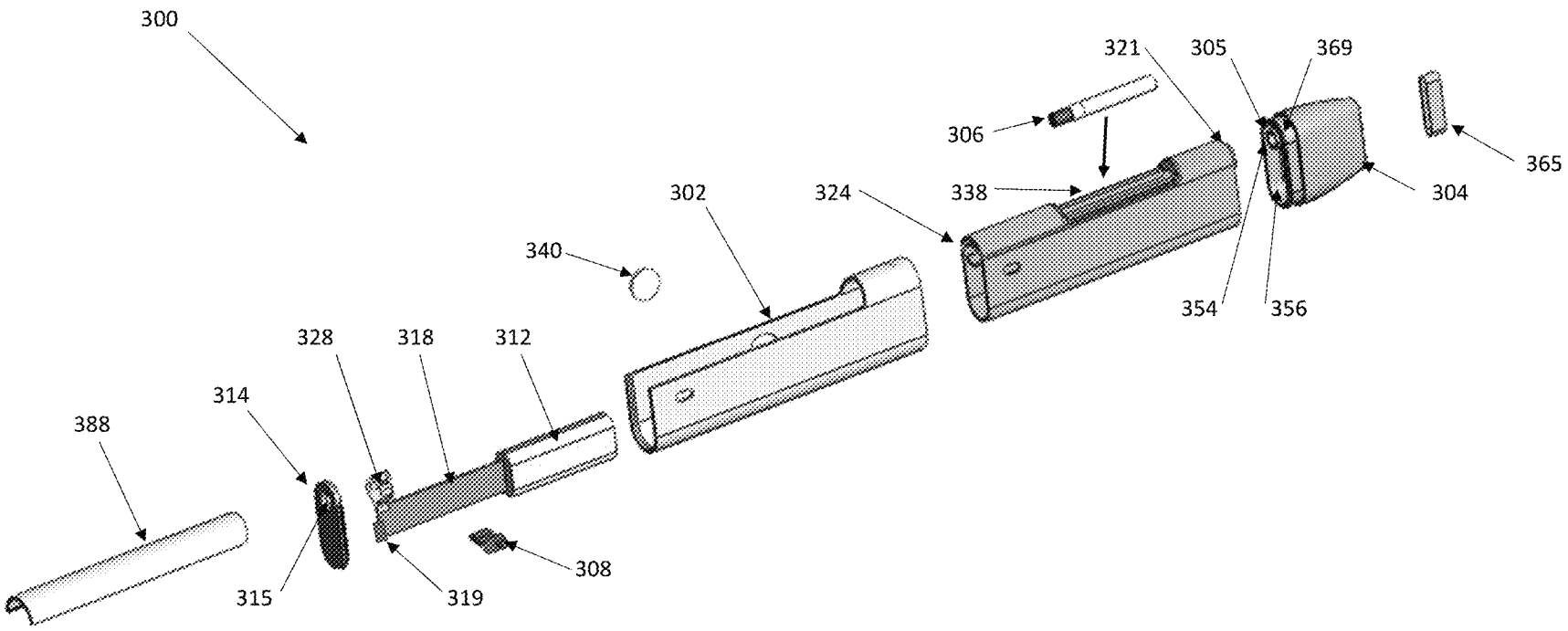
Figure 13:
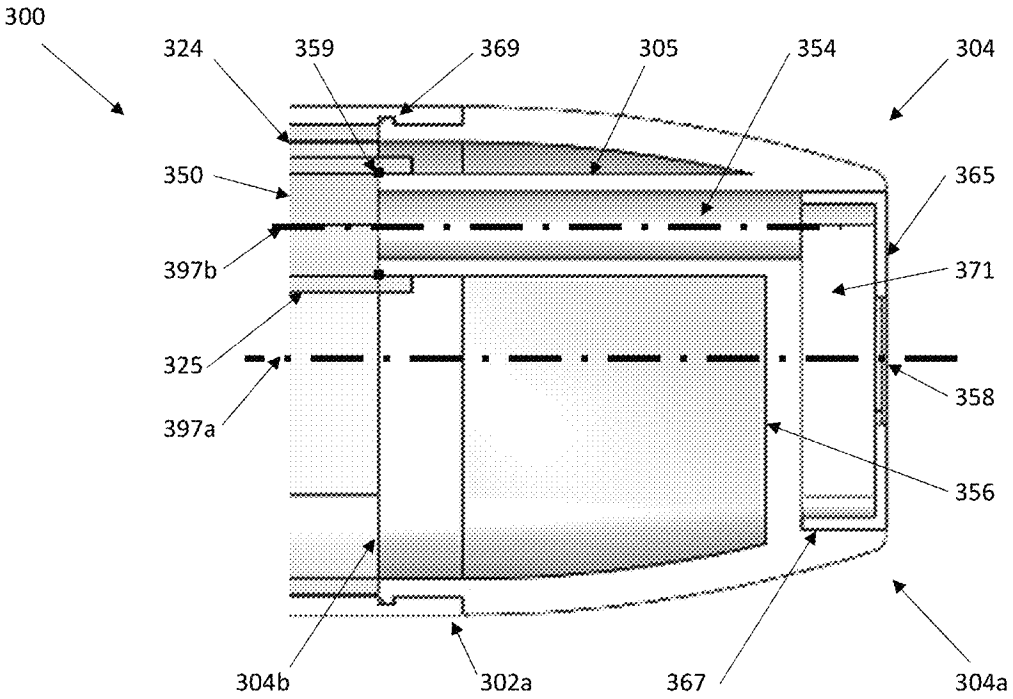
Figure 14B:
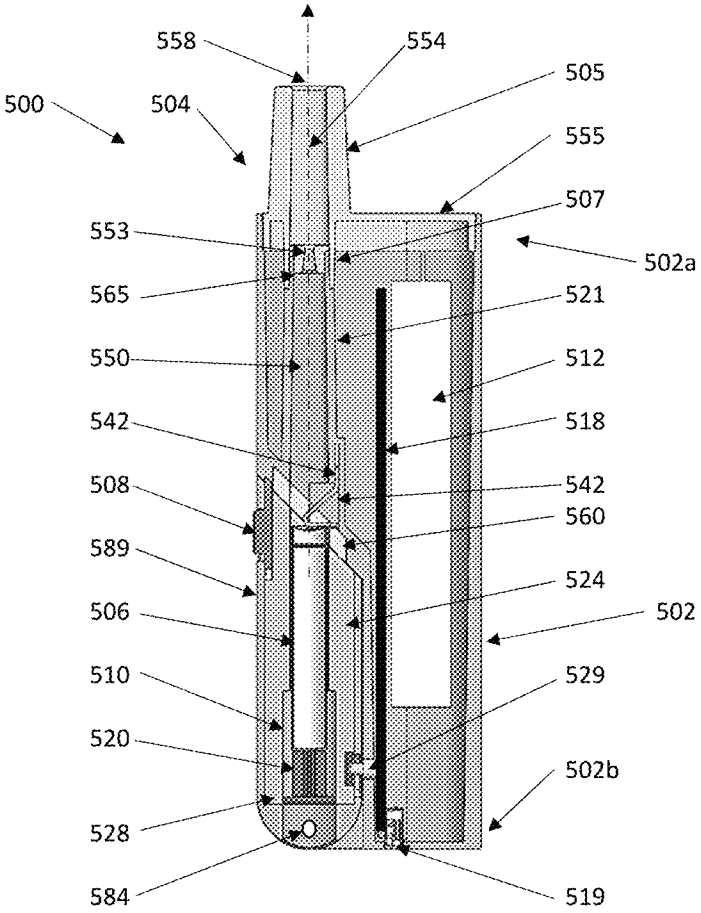
Figure 14A:
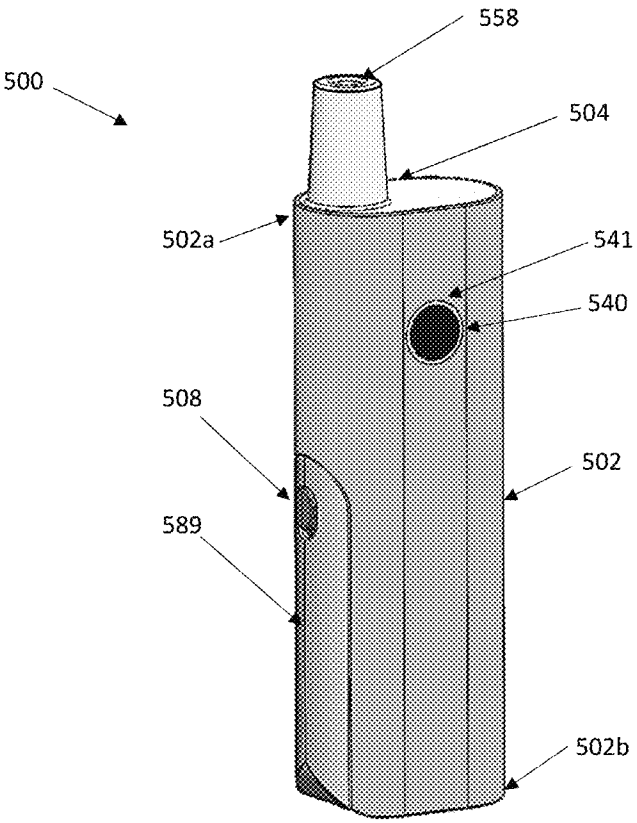
Figure 15:
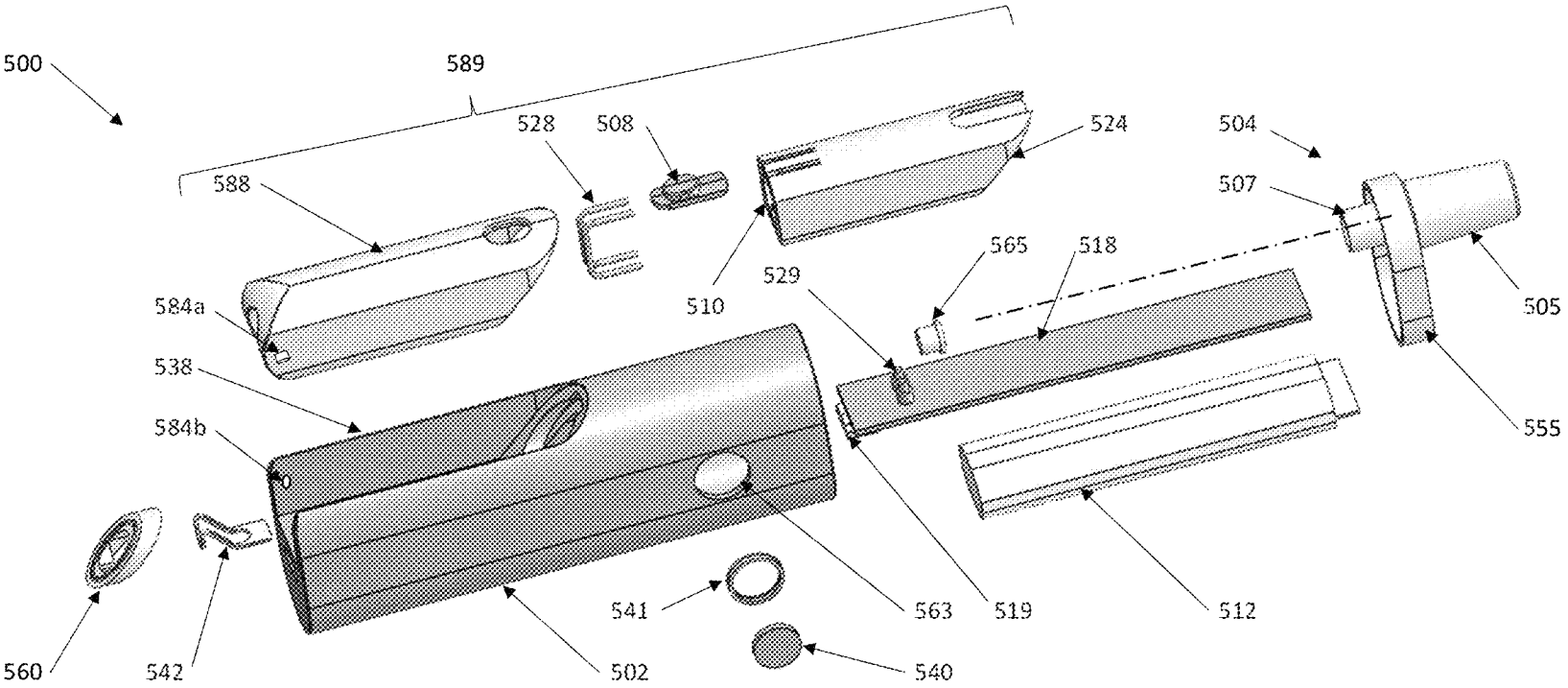
Figure 16B:
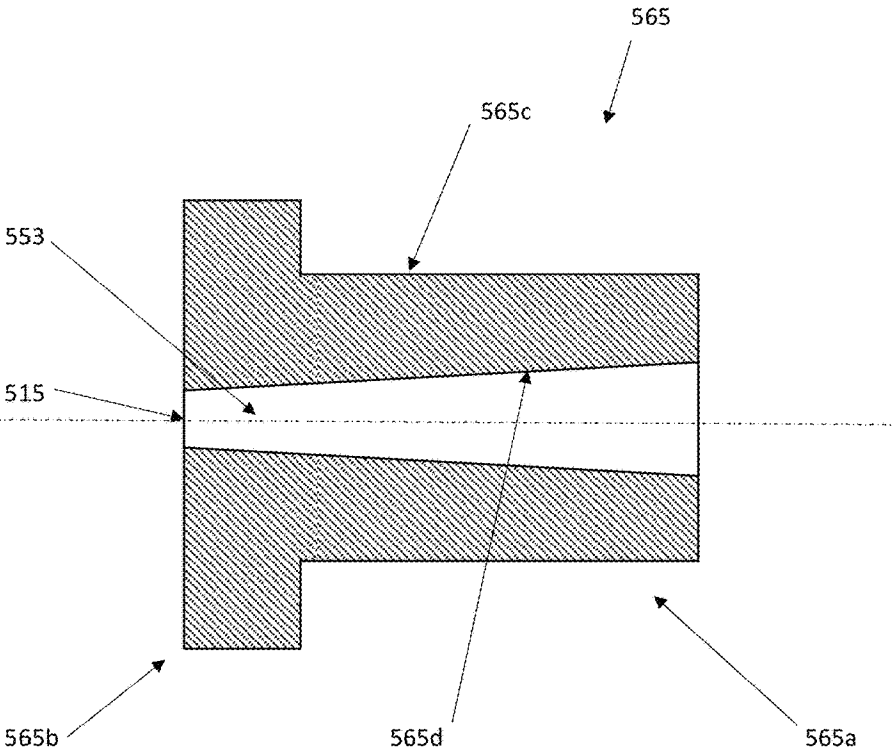
Figure 16A:
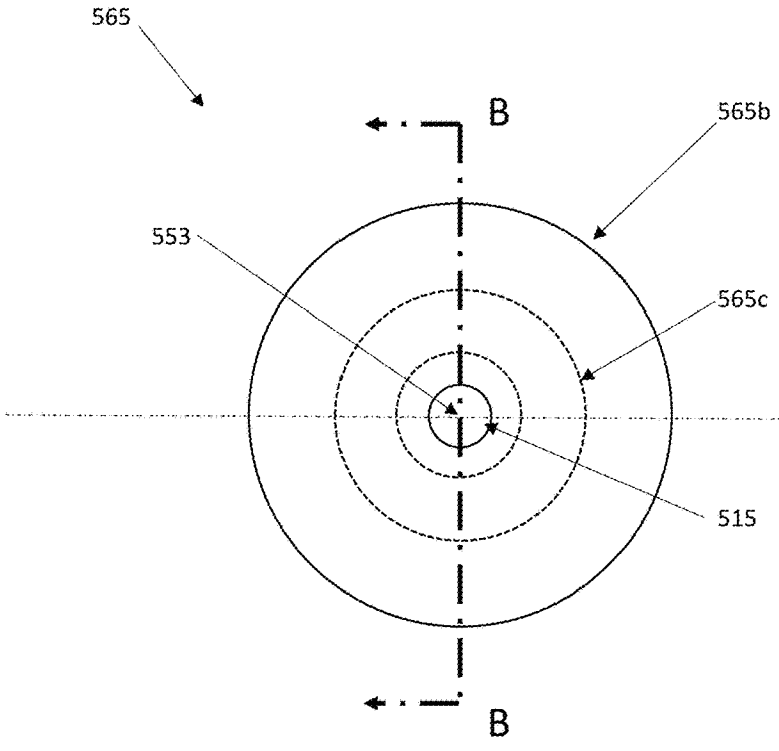
Figure 17C:
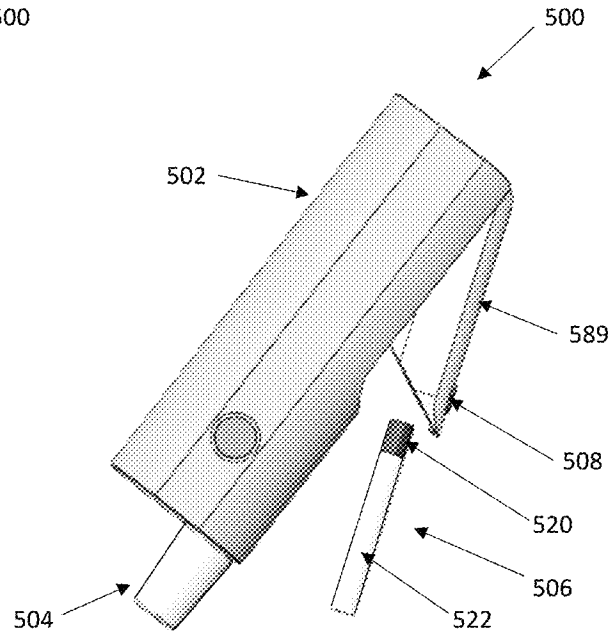
Figure 17B:
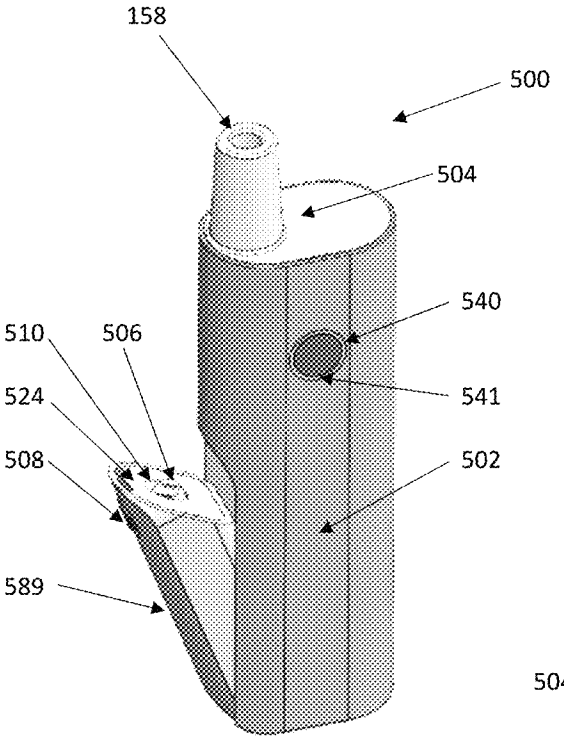
Figure 17A:
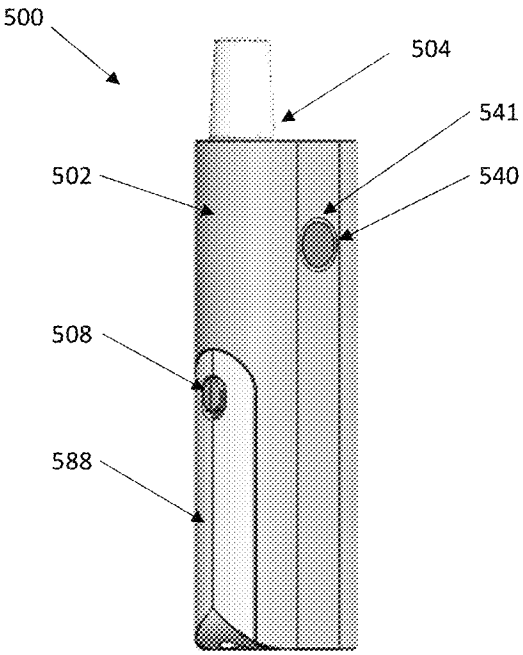
Figure 18A:
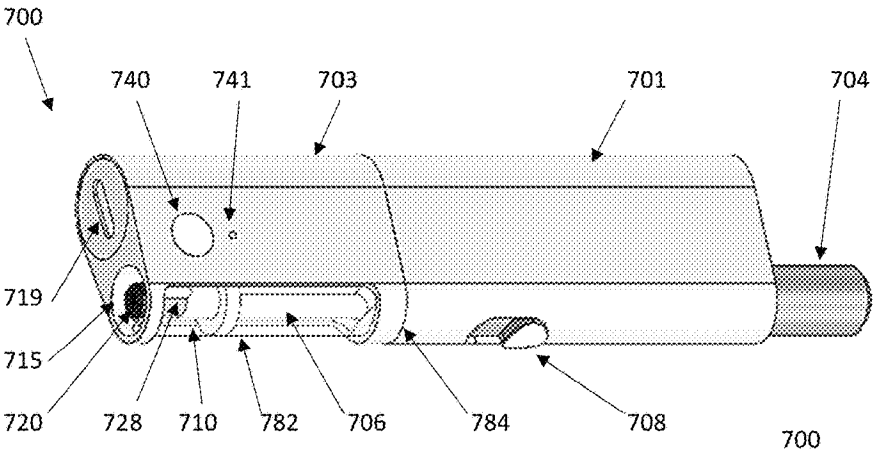
Figure 18B:
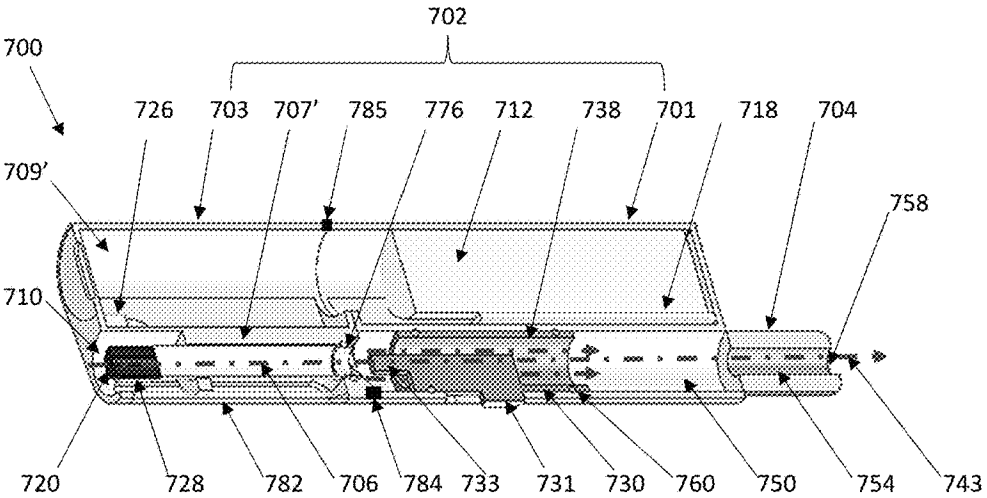
Figure 19:
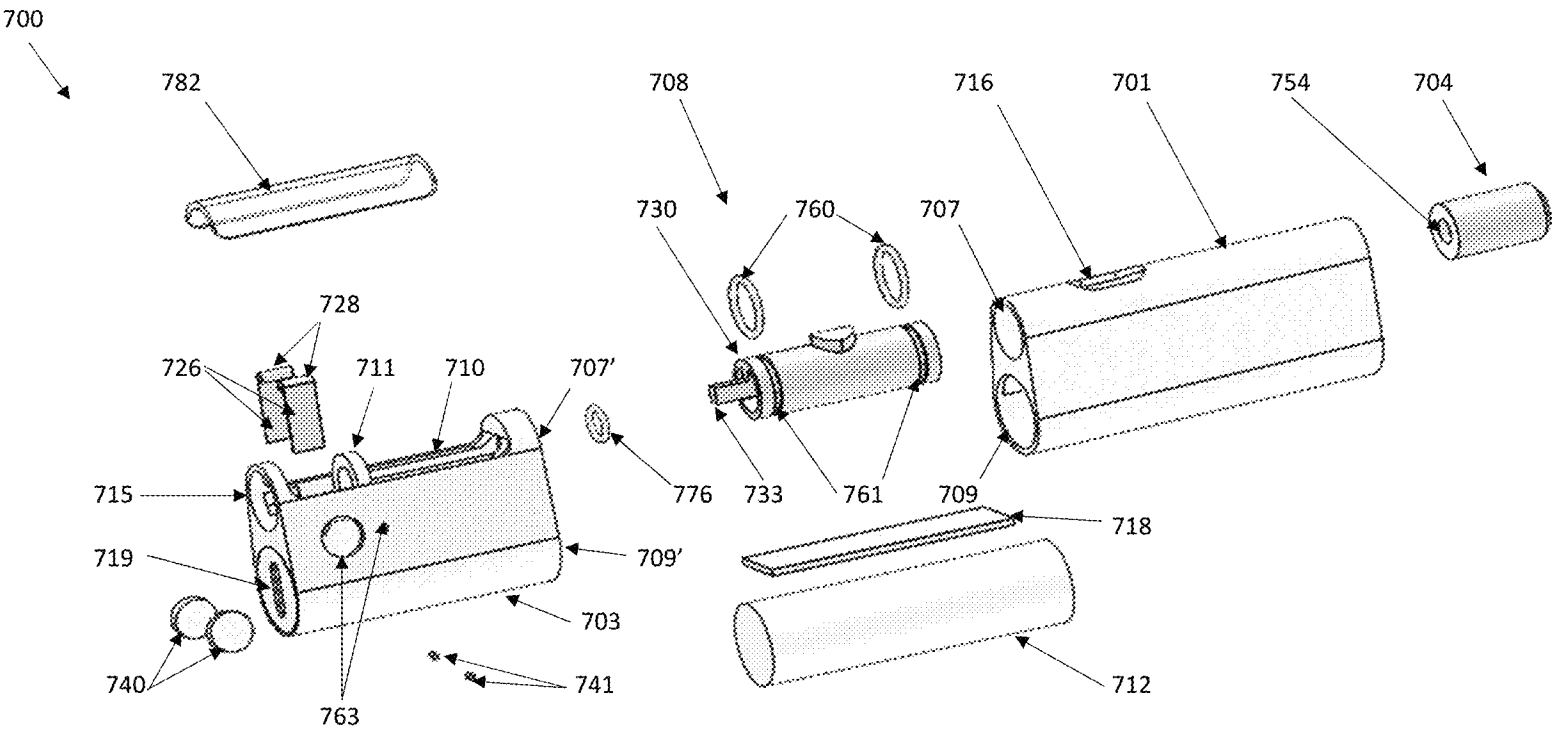
Figure 20B:
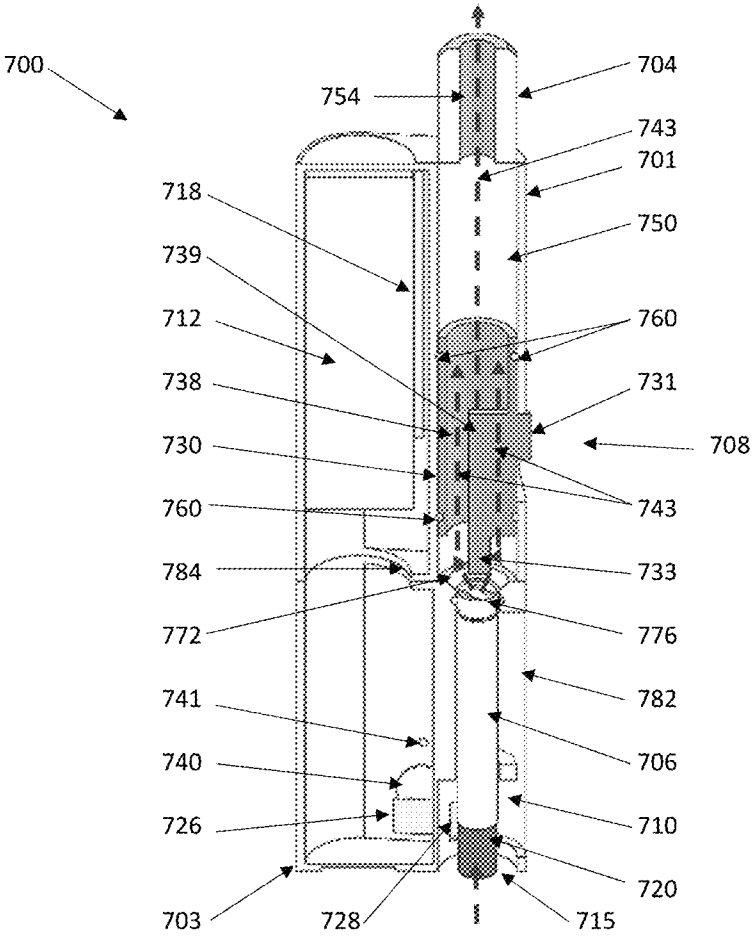
Figure 20A:
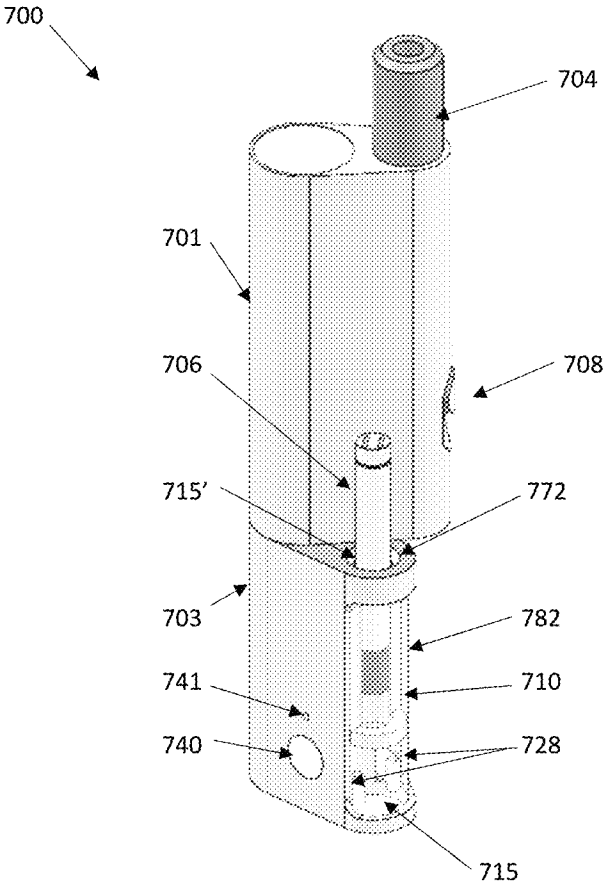
Figure 20C:
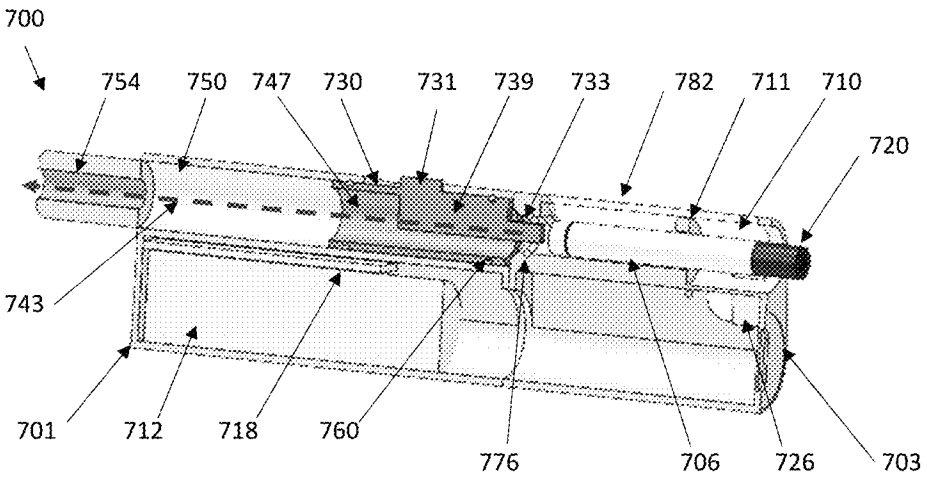
Figure 22:
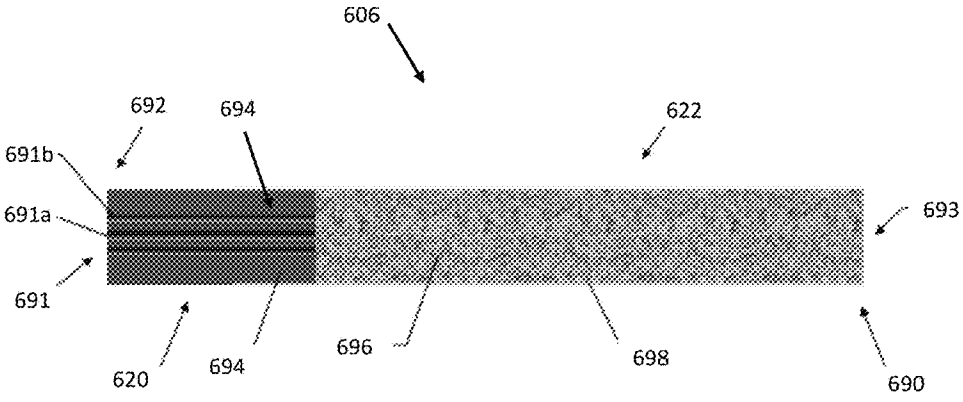
Figure 21:
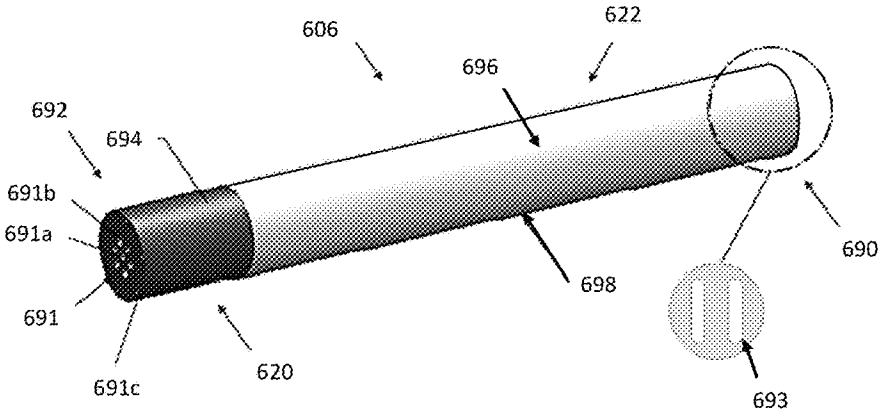

Having thus described the disclosure in the foregoing general terms, reference will now be made to the accompanying drawings, which are not necessarily drawn to scale, and wherein:

FIGS. 1A and 1B illustrate a perspective view and a cross-sectional perspective view, respectively, of an aerosol delivery device comprising a removable mouthpiece and a removable cartridge, with an improved vapor path, according to one implementation of the present disclosure;

FIG. 2 illustrates an exploded view of the aerosol delivery device of FIG. 1A, according to one implementation of the present disclosure;

FIGS. 3A and 3B illustrate a cross-sectional side view and a pictorial perspective view, respectively, of the aerosol delivery device of FIG. 1A, according to one implementation of the present disclosure;

FIGS. 4A-4C illustrate a series of perspective views of the mouthpiece end of the aerosol delivery device of FIG. 1A, according to one implementation of the present disclosure;

FIG. 5 illustrates a partially exploded perspective view of the aerosol delivery device of FIG. 1A, according to one implementation of the present disclosure;

FIGS. 6A and 6B illustrate a cross-sectional side view and a cross-sectional perspective view, respectively, of a portion of the aerosol delivery device of FIG. 1A with an alternative removable mouthpiece configuration, according to one implementation of the present disclosure;

FIG. 7A illustrates an exploded view of the proximal end of the aerosol delivery device of FIG. 6A, according to one implementation of the present disclosure;

FIG. 7B illustrates a partially exploded perspective view of the aerosol delivery device of FIG. 6A, according to one implementation of the present disclosure;

FIGS. 8A and 8B illustrate a perspective view and a cross-sectional perspective view, respectively, of an alternative aerosol delivery device comprising a removable mouthpiece and a removable cartridge, according to one implementation of the present disclosure;

FIG. 9 illustrates an exploded view of the aerosol delivery device of FIG. 8A, according to one implementation of the present disclosure;

FIG. 10 illustrates an enlarged perspective end view of the aerosol delivery device of FIG. 8A, according to one implementation of the present disclosure;

FIGS. 11A and 11B illustrate a perspective view and a cross-sectional side view, respectively, of an alternative aerosol delivery device comprising a removable cartridge and defining an improved vapor path, according to one implementation of the present disclosure;

FIG. 12 illustrates an exploded view of the aerosol delivery device of FIG. 11A, according to one implementation of the present disclosure;

FIG. 13 illustrates an enlarged cross-sectional view of the mouthpiece end of the aerosol delivery device of FIG. 11A, according to one implementation of the present disclosure;

FIGS. 14A and 14B illustrate a perspective view and a cross-sectional side view, respectively, of an aerosol delivery device comprising a removable flow restrictor, according to one implementation of the present disclosure;

FIG. 15 illustrates an exploded perspective view of the aerosol delivery device of FIG. 14A, according to one implementation of the present disclosure;

FIGS. 16A and 16B illustrate an end view and a cross-sectional side view, respectively, of a removable flow restrictor for use in an aerosol delivery device, according to one implementation of the present disclosure;

FIGS. 17A-17C illustrate a series of perspective views of the aerosol delivery device of FIG. 14A in various states or operation, according to one implementation of the present disclosure;

FIGS. 18A and 18B illustrate a perspective view and a cross-sectional perspective view, respectively, of another alternative aerosol delivery device comprising a removable cartridge and defining an improved vapor path, according to one implementation of the present disclosure;

FIG. 19 illustrates an exploded view of the aerosol delivery device of FIG. 18A, according to one implementation of the present disclosure;

FIGS. 20A-20C illustrate a perspective view and two cross-sectional perspective views, respectively, of the aerosol delivery device of FIG. 18A in different operational stages, according to one implementation of the present disclosure;

FIG. 21 illustrates a perspective view of a removable cartridge, according to one implementation of the present disclosure; and FIG. 22 illustrates a longitudinal cross-section view of a removable cartridge, according to one implementation of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably. Additionally, where multiples of the same components are described, the multiples may be referred to individually (e.g., ##a, ##b, ##c, etc.) or collectively (##).

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some aspects, articles or devices characterized as smoking articles incorporate tobacco and/or components derived from tobacco.

As noted, aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that device much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

Examples of suitable vapor-producing articles, aerosol delivery articles, or medicament delivery articles include vapor products, heat-not-burn products, hybrid products and the like. Vapor products are commonly known as "electronic cigarettes," "e-cigarettes" or electronic nicotine delivery systems (ENDS), although the aerosol-generating material need not include nicotine. Many vapor products are designed to heat a liquid material to generate an aerosol. Other vapor products are designed to break up an aerosol-generating material into an aerosol without heating, or with only secondary heating. Heat-not-burn products include tobacco heating products and carbon-tipped tobacco heating products, and many are designed to heat a solid material to generate an aerosol without combusting the material.

Hybrid products use a combination of aerosol-generating materials, one or a plurality of which may be heated. Each of the aerosol-generating materials may be, for example, in the form of a solid, semi-solid, liquid, or gel. Some hybrid products are similar to vapor products except that the aerosol generated from a liquid or gel aerosol-generating material passes through a second material (such as tobacco) to pick up additional constituents before reaching the user. In some example implementations, the hybrid system includes a liquid or gel aerosol-generating material, and a solid aerosol-generating material. The solid aerosol-generating material may include, for example, tobacco or a non-tobacco product.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. In some example implementations, an elongated body resembling the shape of a cigarette or cigar can be formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In another example, an aerosol delivery device may be substantially rectangular or have a substantially rectangular cuboid shape. In one example, all of the components of the aerosol delivery device are contained within one housing. Alternatively, an aerosol delivery device can comprise two or more housings that are joined and are separable. For example, an aerosol delivery device can possess one portion comprising a housing containing one or more reusable components (e.g., an accumulator such as a rechargeable battery and/or rechargeable supercapacitor, and various electronics for controlling the operation of that article), and removably coupleable thereto, another second portion (e.g., a mouthpiece) and/or a disposable component (e.g., a disposable flavor-containing cartridge containing aerosol precursor material, flavorant, etc.). More specific formats, configurations and arrangements of components within the single housing type of unit or within a multi-piece separable housing type of unit will be evident in light of the further disclosure provided herein. Additionally, various aerosol delivery device designs and component arrangements can be appreciated upon consideration of the commercially available electronic aerosol delivery devices.

As will be discussed in more detail below, holders of aerosol delivery devices of the present disclosure may comprise some combination of a power source (e.g., an electrical power source), at least one control component (e.g., means for actuating, controlling, regulating and ceasing power, such as by controlling electrical current flow from the power source to other components of the article—e.g., a microprocessor, individually or as part of a microcontroller, a printed circuit board (PCB) that includes a microprocessor and/or microcontroller, etc.), a lighter portion configured heat a heat source and/or substrate material of a cartridge, and a receiving chamber. Such holders may be configured to accept one or more substrate cartridges that include a substrate material capable of yielding an aerosol upon application of sufficient heat. In some implementations, the holder may include a mouthpiece portion configured to allow drawing upon the holder for aerosol inhalation (e.g., a defined airflow path through the holder such that aerosol generated can be withdrawn therefrom upon draw).

In various aspects, the heat source of a cartridge may be capable of generating heat to aerosolize a substrate material of the cartridge that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. As will be described in more detail below, in some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

In some implementations, the substrate material may comprise a liquid including an aerosol precursor composition and/or a gel including an aerosol precursor composition. Some examples of liquid compositions can be found in U.S. Pat. Pub. No. US 2020/0113239 to Aller et al., which is incorporated herein by reference in its entirety. As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha Arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

More specific formats, configurations and arrangements of components within the non-combustible aerosol provision systems of the present disclosure will be evident in light of the further disclosure provided hereinafter. Additionally, the selection and arrangement of various non-combustible aerosol provision system components can be appreciated upon consideration of the commercially available electronic non-combustible aerosol provision systems, such as those representative products referenced in the background art section of the present disclosure.

According to certain aspects of the present disclosure, it may be advantageous to provide an aerosol delivery device that is easy to use and provides improved performance. FIGS. 1A, 1, 2, 3A, and 3B illustrate one example implementation of such a device. In particular, FIGS. 1A and 1B illustrate a perspective view and a cross-sectional perspective view, respectively, of an aerosol delivery device 100 that includes an optional actuator assembly 108 and a mouthpiece 104. Specifically, the aerosol delivery device 100 comprises a holder 102 having a main body defining a proximal end 102*a* and a distal end 102*b*, where the holder 102 further defines a receiving chamber 110 configured to receive a removable cartridge (106 in FIG. 3A) and a first aerosol passageway 150 that extends through at least a portion of the main body. The removable cartridge 106 comprises an ignitable heat source 120 and a substrate portion 122 that includes a substrate material having an aerosol precursor composition configured to form an aerosol upon application of heat thereto. The mouthpiece 104 has a first end and a longitudinally opposed second end with a second aerosol passageway 154 extending longitudinally therebetween. In the depicted implementation, the mouthpiece 104 is located proximate the proximal end 102*a* of the holder 102 with the first end configured to engage with a user's mouth and the second end configured to be coupled to the proximal end of the holder 102. The device 100 also includes a power source 112 disposed within the holder 102. The slider actuator assembly 108 is coupled to the holder 102 and configured to ignite the ignitable heat source and/or eject the removable cartridge 106.

As further illustrated by the exploded view of FIG. 2, the actuator assembly 108 comprises a slider body 130 slidably disposed within the main body of the holder 102 and having an upper track 132, a lower track 134, and a slider body collar 136 coupling the upper and lower tracks and defining a receptacle 138 (see FIG. 1A or 3A) configured to at least partially receive the removable cartridge, a spring-loaded push button 140 engaged with the upper track 132 of the slider body 130 so as to move the actuator assembly 108 between a loading position, a lighting position, and an ejecting position, and a spring assembly 142 configured to engage the slider body 130 and bias the actuator assembly 108 into the loading or other "neutral" position. The slider body 130 is configured to slide along a length of the main body in a first direction and a second direction. The push button 140 is configured to engage an electrical contact 129 when in the lighting position. In one implementation, the push button 140 extends through an opening in a top surface of the upper track 132 and is slideably secured thereto. The button 140 is spring loaded so as to return to an off position after igniting the heat source. The holder 102 defines a slot 116 through a surface thereof that is sized and shaped to slidably receive the spring-loaded push button 140 therein. In some implementations, the upper track 132 of the slider body 130 is sealingly engaged with the holder about the slot 116, for example, via a gasket 117 disposed within a recess formed in the top surface of the slider body 130.

The actuator assembly 108 further comprises a pair of actuatable ignitor contacts 128*a*, 128*b* (collectively 128) disposed proximate the distal end 102*a* of the holder and configured to be engaged with the ignitable heat source when the removable cartridge is secured within the receiving chamber 110 and when the actuatable ignitor contacts 128 are actuated by a user. The ignitor contacts 128 are coupled to and disposed at the distal ends of a pair of elongate bodies 125; however, in other implementations, the contacts 128 and elongate bodies 125 are a single piece formed into an appropriate configuration. The ignitor contacts 128 are coupled to the slider body 130 via a pair of contact arms 126 that are disposed within grooves 135 defined by the upper and lower tracks 132, 134. Specifically, a first contact arm 126*a* is pivotably coupled to the main body of the holder 102 and configured to receive one of the pair of actuatable ignitor contacts 128*a* in a retaining groove 127*a* formed within an inner surface of the contact arm 126*a* and a second contact arm 126*b* is pivotably coupled to the main body of the holder 102 and configured to receive the other one of the pair of actuatable ignitor contacts 128*b* in a retaining groove 127*b* (not shown, but mirror image of 127*a*) formed within an inner surface of the second contact arm 126*b*. The contact arms 126 are further coupled to the sliding body 130 (e.g., via pivot pins 180) so that sliding movement of the sliding body 130 into the lighting position causes the contact arms 126 to pivot into a closed configuration where the ignitor contacts 128 move into contact with the ignitable heat source 120. Additionally, the contact arms 126 may be chamfered at the ends thereof that engage the slider body 130 so as to accommodate the pivoting of the arms 126 within the holder 102.

The receiving chamber 110 of the device 100 is further defined by an end cap 114 engaged with the distal end 102*b* of the holder and defining an opening 115 configured to receive the removable cartridge 106 therethrough, an outlet guide 144 coupled to the slider body slider body collar 136 and slidably disposed within the main body of the holder 102 and through the end cap 114, and an inner slider seal body 146 disposed within the receptacle 138 of the slider body 130 and coupled thereto (e.g., frictionally engaged therewith via a sealing surface), the inner slider seal body 146 defining a cavity configured to sealingly engage and removably secure the removable cartridge 106 therein. For example, the inner slider seal body 146 may include an elastomeric sleeve 148 disposed therein that includes a protuberance or ring 176 extending radially inwardly from a wall of the sleeve that is configured to frictionally and/or sealingly engage an outer surface of the removable cartridge 106. In some implementations, the elastomeric sleeve 148 may be integral with the inner slider seal body 146, such as, for example, as part of an over-molded part. The inner slider seal body 146 may include a leading edge or lip 149 configured to contact or otherwise engage with the spring assembly 142 with a protuberance or ring 172 disposed about an outer surface of the seal body 146 proximate an end opposite of the leading edge that is configured to engage an edge of the end cap 114 that extends within the holder 102. Additionally, the elastomeric sleeve 148 includes a protuberance or ring 170 extending radially outwardly from an exterior wall of the sleeve 148 that is configured to frictionally and/or sealingly engage with an inner wall of the receptacle 138.

The outlet guide 144 defines a passageway that forms a portion of the receiving chamber 110 configured to pass the removable cartridge therethrough and comprises a pair of opposing slots 145 through a wall of the outlet guide 144 that are configured to allow the ignitor contacts 128 to pass therethrough to engage the ignitable heat source 120. The outlet guide 144 may be snap fit to the slider body collar 136 via, for example, mating slots and protuberances. The slider body collar 136 of the slider body 130 includes an inner stem 133 disposed within the receptacle 138 and engageable with one end of the removable cartridge and defining a passageway 139 (part of the first aerosol passageway 150) therethrough for passing an aerosol generated from the removable cartridge. The end cap 114 removably engages the holder 102 via, for example, one or more of a snap-fit, interference fit, screw thread, magnetic, and/or bayonet connection. In other implementations, the end cap may be permanently engaged with the holder 102 after assembly to secure the various components therein. The end cap 114 may be translucent or transparent so as to allow light from the ignitable heat source to pass therethrough when lit. Similarly, the push button 140 may also be translucent or transparent to allow, for example, light from an LED to pass therethrough that is indicative of a state of the device 100.

The device 100 further comprises an inner housing 124 disposed within the holder 102 and defining an inner cavity 123 configured to receive the power source 112 and a printed circuit board 118 therein. The printed circuit board 118 is in electrical communication with the power source 112 and includes the electrical contact 129 disposed thereon for actuation by the slider push button 140 when the actuator assembly 108 is in the lighting position. The power source 112 is in electrical communication with the ignitor contacts 128 via a pair of wires 168 or other electrical connection mechanism. In one implementation, the wires 168 run at least partially within grooves 166 defined by a pair of fingers 164 that extend from a distal end of the inner housing 124. The printed circuit board may further comprise a charging port 119 that is oriented on the printed circuit board so as to be disposed at the proximal end of the holder 102 and accessible by, for example, removing the mouthpiece 104.

The inner housing 124 further defines a third aerosol passageway 147. In the depicted implementation of FIGS. 3A and 3B, the third aerosol passageway is made up of a first port 151*a* disposed in a first or proximal end 124*a* of the inner housing, a second port 151*b* disposed in a second or distal end 124*b* of the inner housing with one or more channels 151 disposed in an outer surface of the inner housing 124. As shown in FIGS. 4A-4C, two channels 151 are disposed in opposing side of the inner housing 124 and enclosed by an inner surface of the holder 102, thereby defining two parallel third aerosol passageways 147 (see FIG. 4A) that extend around the battery 112, the printed circuit board 118, and associated electronics disposed in the inner housing 124. In addition, the distal end 124*b* of the inner housing sealingly engages with the slider body 130

(e.g., with a gasket or O-ring 178) when the actuator assembly is in the lighting position so as to be in fluid communication with the passageway 139 defined by the inner stem 133 (i.e., a fourth aerosol passageway 139) and to provide the aerosol from the cartridge 106/first aerosol passageway 150 to the third aerosol passageway 147 further defined by the inner housing 124. Generally, the aerosol (vapor path 143) enters the third aerosol passageway 147 via the second port 151*b*, where it is divided into two vapor paths 143 that run along the channels 151 disposed in each side of the inner housing 124. The two vapor paths merge at the proximal end 124*a* of the inner housing and exit through the first port 151*a*, which is in fluid communication with a second aerosol passageway 154 within the mouthpiece 104.

In some implementations, the opening 115 in the end cap 114 allows for the introduction of ambient air to the receiving chamber 110 and cartridge 106. However, in other implementations not depicted, the holder may include one or more apertures therein for allowing entrance of ambient air to be directed into the receiving chamber and/or the aerosol passageway (such as, for example, through the substrate cartridge and/or downstream from the substrate cartridge). Thus, when a user draws on the holder (e.g., via the mouthpiece portion thereof), air may be drawn into the receiving chamber and/or the aerosol passageway for inhalation by the user (e.g., by traveling through the first, second, third, and optionally fourth aerosol passageways and out the first end 104*a* of the mouthpiece). In some implementations, for example where the mouthpiece 104 is removable, the aerosol delivery device 100 includes a collar 152 that sealingly engages with the proximal end 102*a* of the holder at one end and sealingly engages with the mouthpiece 104 at the other end, as described in greater detail below. The collar 152 defines a channel or fifth aerosol passageway 153 that fluidly couples the third aerosol passageway 147 with the second aerosol passageway 154, further defining the vapor path 143.

The removable mouthpiece 104 is described in greater detail with respect to FIGS. 4C and 5. In the depicted implementation, the mouthpiece 104 is coupled to the holder 102 via the collar 152 that sealingly engages with the proximal end 102*a* of the holder at one end and sealingly engages with the mouthpiece 104 at the other end. Specifically, the collar comprises a base portion 155 and a body portion 157, each of which defines an opening in fluid communication with a first channel 153 that extends through the collar 152. The base portion 155 includes a first sealing mechanism 163*a* that is disposed about an exterior surface thereof. As shown, the first sealing mechanism 163*a* comprises an O-ring 160 disposed within a groove 161 defined by the exterior surface of the base portion. The base portion 155 is sized and shaped to engage an opening in the proximal end of the holder 102, such that the base portion is disposed within the proximal end of the holder and the first sealing mechanism 163*a* engages an inner wall of the holder 102. In some implementations, the base portion 155 may be coupled to the holder 102 via at least one fastener 162. For example, the inner housing 124 may be configured such that the base portion 155 is secured to the inner housing via the at least one fastener 162 (e.g., a screw).

The body portion 157 includes a second sealing mechanism 163*b* disposed about an exterior surface thereof. As shown, the second sealing mechanism 163*b* comprises at least one O-ring 160 disposed within one or more grooves 161 defined by the exterior surface of the body portion. The body portion 157 is sized and shaped to engage a recess 156 disposed within the second end 104*b* of the mouthpiece 104, such that the body portion is substantially fully disposed within the recess 156 with the second sealing mechanism 163*b* engaging an inner wall of the recess 156. The second sealing mechanism 163*b* provides frictional resistance between the mouthpiece 104 and the collar 152, which is sufficient to secure the mouthpiece 104 to the holder 102 via the collar 152, but minimal enough so that a user may remove the mouthpiece 104 without significant effort. The mouthpiece can be removed for cleaning and then reattached for continued use or, in some cases, a different mouthpiece may be attached to customize the user's experience.

As shown in FIGS. 4C and 5, the first channel 153 extends through the collar 152 so as to fluidly couple the third aerosol passageway 147 of the inner housing 124 and the second aerosol passageway 154 of the mouthpiece 104, thereby completing the vapor path 143 extending from the receiving chamber 110, through the first aerosol passageway 150, the fourth aerosol passageway 139, the third aerosol passageway 147, the fifth aerosol passageway 153, and the second aerosol passageway 154, and out through the opening 158 in the mouthpiece portion 104. Generally, the first, second, third, and fourth aerosol passageways (and the fifth aerosol passageway of present) are configured to define the continuous vapor path 143 from the distal end 102*b* of the main body to the first end 104*a* of the mouthpiece.

In some implementations, the collar 152 includes a second channel 159 extending therethrough that is sized and shaped to at least partially receive the charging port 119 (e.g., a micro-USB connector) therein, so that a user may access the port 119 by removing the mouthpiece 104. In some implementations, the second channel 159 is at least partially defined by a portion of the inner housing 124, which may separate the second channel 159 from the first channel 153.

FIGS. 6A and 6B illustrate cross-sectional side and perspective views, respectively, of an another implementation of an aerosol delivery device 400 similar to the device 100 described with respect to FIGS. 1A and 1B. Specifically, the device 400 includes an alternative arrangement for a removable mouthpiece 404. The figures are limited to the proximal end of the device 400 for illustrative purposes only. Specifically, the figures depict the aerosol delivery device 400 comprising a holder 402 having a main body defining a proximal end 402*a* and a distal end (not shown), where the holder 402 further defines a receiving chamber (not shown, but similar to those described hereinabove) that is configured to receive a removable cartridge therein. The device further defines an aerosol passageway 450 that extends through at least a portion of the main body and to the mouthpiece 404. The mouthpiece 404 has a first end 404*a* and a longitudinally opposed second end 404*b* with a second aerosol passageway 454 extending longitudinally therebetween. In the depicted implementation, the mouthpiece 404 is located proximate the proximal end 402*a* of the holder 402 with the first end configured to engage with a user's mouth and the second end coupleable to the proximal end of the holder 402. The device 400 also includes a power source 412 and associated electronics or other controls disposed within the holder 402.

With reference to FIGS. 6A, 6B, 7A, and 7B, the mouthpiece 404 is coupled to the holder 402 via a collar 452 that engages with the proximal end 402*a* of the holder 402 at one end and sealingly engages with the mouthpiece 404 at the other end. Specifically, the collar comprises a base portion 455 and a body portion 457, each of which defines an opening in fluid communication with a channel 453 that extends through the collar 452. The base portion 455 is sized and shaped to engage an opening in the proximal end of the holder 402 via, for example, at least one of complementary-threaded surfaces for a screw-type engagement, a press-fit engagement, a snap-fit engagement, or a magnetic engagement. In some implementations, the base portion 455 may include a sealing mechanism for sealingly engaging with the holder 402. In some implementations, the base portion 455 may also be coupled to the holder 402 via at least one fastener 462.

The body portion 457 includes a sealing mechanism 463 disposed about an exterior surface thereof. As shown, the sealing mechanism 463 comprises at least one O-ring 460 disposed within one or more grooves 461 defined by the exterior surface of the body portion. The body portion 457 is sized and shaped to engage a recess 456 disposed within the second end 404*b* of the mouthpiece 404, such that the body portion is substantially fully disposed within the recess 456 with the sealing mechanism 463 engaging an inner wall of the recess 456. The sealing mechanism 463 provides frictional resistance between the mouthpiece 404 and the collar 452, which is sufficient to removably secure the mouthpiece 404 to the holder 402 via the collar 452, but minimal enough so that a user may remove the mouthpiece 404 without significant effort. The mouthpiece can be removed for cleaning and then reattached for continued use or, in some cases, a different mouthpiece may be attached to customize the user's experience.

As shown in FIG. 6A, the channel 453 extends through the collar 452 so as to fluidly couple the aerosol passageway 450 of the inner housing 424 and the aerosol passageway 454 extending through the mouthpiece 404, thereby completing an aerosol path extending from the receiving chamber, through the inner housing 424, and out through the opening 458 in the mouthpiece portion 404. In addition, the collar 452 includes a stem 473 extending distally from the base portion 455 and further defining the channel 453 extending through the collar 452. When assembled, the stem 473 extends into the holder and engages the inner housing 424. Specifically, the stem 473 is at least partially inserted into the aerosol passageway 450 defined by the inner housing 424. The stem 473 may be coupled to the inner housing 424 via, for example, a press-fit or snap-fit engagement.

Generally, when the actuator assembly 108 is moved into the lighting position, the lower track 134 of the slider body 130 forces the contact arms 126 into their closed configuration (i.e., the ignitor contacts 128 are in contact with the heat source 120). Specifically, the contact arms 126 are engaged with the slider body 130 and pivotably coupled to the holder 102 so that when the actuator assembly 108 is moved into the lighting position, the outlet guide 144 is translated toward the proximal end 102*a* of the holder 102. In this manner, the contact arms 126 are no longer supported in their open configuration by the outlet guide 144 and are able to pivot into the closed configuration so that the ignitor contacts 128 are in contact with the heat source 120. Once the push button 140 is actuated, the electrical circuit is completed and the electricity is delivered to the ignitor contacts 128.

In some alternative implementations, the aerosol is generated by an electric heater configured to perform electric heating in which electrical energy from the power source is delivered to the heater when the actuator assembly is moved into the lighting/use position. Subjecting the aerosol-generating material (substrate 122) to heat releases one or more volatiles from the aerosol-generating material to form an aerosol. Examples of suitable forms of electric heating include resistance (Joule) heating, induction heating, dielectric and microwave heating, radiant heating, arc heating and the like. More particular examples of suitable electric heaters include resistive heating elements such as wire coils, flat plates, prongs, micro heaters or the like.

In some examples, the cartridge 106 may include a susceptor (e.g., the susceptor may be part of the substrate 122). The susceptor is a material that is heatable by penetration with a varying magnetic field generated by a magnetic field generator that may be separate from or part of the aerosol generator. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor in some examples may be both electrically-conductive and magnetic, so that the susceptor of these examples is heatable by both heating mechanisms.

FIGS. 8A, 8B, 9, and 10 illustrate another example implementation of an aerosol delivery device 200. In particular, FIGS. 8A and 8B illustrate a perspective view and a cross-sectional perspective view, respectively, of an aerosol delivery device 200 that includes a removable mouthpiece 204. Specifically, the aerosol delivery device 200 comprises a holder 202 having a main body defining a proximal end 202*a* and a distal end 202*b*, where the holder 202 further defines a receiving chamber 210 configured to receive a removable cartridge (206 in FIG. 9) and an aerosol passageway 250 that extends through at least a portion of the main body. In some implementations, the removable cartridge 206 comprises an ignitable heat source 220 and a substrate portion 222 that includes a substrate material having an aerosol precursor composition configured to form an aerosol upon application of heat thereto. The device 200 further comprises an optional actuator assembly 208 configured to be movable between different positions, such as a loading position and an ejecting position. The mouthpiece 204 is removably secured to the holder 202 as described in greater detail below.

As further illustrated by the exploded view of FIG. 9, the actuator assembly 208 comprises a slider body 230 slidably disposed within the main body of the holder 202 and having an upper track 232 and a lower track 234 coupled together via a generally cylindrical body that defines an interior space including a receptacle 238 configured to at least partially receive the removable cartridge, a slider button 231 engaged with the upper track 232 of the slider body 230 so as to move the actuator assembly 208 between a loading position, a lighting position, and an ejecting position. The slider body 230 is configured to slide along a length of the main body in a first direction and a second direction. A locating feature 237 (such as, for, example, a spring-loaded ball plunger mechanism) and one or more corresponding detents may be included to temporarily locate the actuator assembly 208 in one or more of the loading, lighting, and ejecting positions.

In one implementation, the slider button 231 extends through an opening in a top surface of the upper track 232 and is secured thereto to allow a user to slide the slider body 230 relative to the holder. The holder 202 defines a slot 216 through a surface thereof that is sized and shaped to slidably receive the slider button 231 therein. In some implementations, the upper track 232 of the slider body 230 is sealingly engaged with the holder about the slot 216.

The actuator assembly 208 further comprises a pair of static ignitor contacts 228 disposed proximate the distal end 202*a* of the holder and configured to be engaged with the ignitable heat source when the removable cartridge is secured within the receiving chamber 210. The ignitor contacts 228 are coupled to the printed circuit board 218 via a pair of contact arms 226 that allow the contacts 228 to flex outwardly via insertion of the cartridge 206 so that they contact the ignitable heat source 220 of the cartridge after loading. In one implementation, an ignitor push button 240 is included that is configured, when pressed by a user, to activate the ignitor contacts 228 thereby igniting the heat source 220 (i.e., the electrical circuit is completed and the electricity is delivered to the ignitor contacts 228). In some implementations, the ignitor contacts 228 will only remain activated while the ignitor push button 240 is depressed. As such, in some implementations, the ignitor contacts 228 will be deactivated when the ignitor push button 240 is released and/or the contacts may stay activated for a specific period of time.

The receiving chamber 210 of the device 200 is further defined by an end cap 214 engaged with the distal end 202*b* of the holder and defining an opening 215 configured to receive the removable cartridge 206 therethrough, a heat sink 286 disposed in the distal end of the holder 202 and secured to the end cap 214 or the holder 202, and an inner slider seal body 246 disposed within the receptacle 238 of the slider body 230 and coupled thereto (e.g., frictionally engaged therewith via a sealing surface). The inner slider seal body 246 defines a cavity configured to sealingly engage and removably secure the removable cartridge 206 therein. For example, the inner slider seal body 246 may include an elastomeric sleeve 248 disposed therein that includes a protuberance or ring 276 extending radially inwardly from a wall of the sleeve that is configured to frictionally and/or sealingly engage an outer surface of the removable cartridge 206. In some implementations, the elastomeric sleeve 248 may be integral with the inner slider seal body 246, such as, for example, as part of an over-molded part. Additionally, the elastomeric sleeve 248 includes a protuberance or ring 270 extending radially outwardly from an exterior wall of the sleeve 248 that is configured to frictionally and/or sealingly engage with an inner wall of the receptacle 238. The heat sink 286 defines a passageway that forms a portion of the receiving chamber 210 configured to pass the removable cartridge therethrough and to accommodate the ignitor contacts 228 positioned therein to engage the ignitable heat source 220. The heat sink 286 may be snap fit to the end cap 214 or the distal end 202*b* of the holder.

The slider body 230 includes an inner stem 233 disposed within the receptacle 238 that is configured to engage one end of the removable cartridge 206 and define a passageway 250 therethrough for passing an aerosol generated from the removable cartridge to the mouthpiece 204. The end cap 214 removably engages the holder 202 via, for example, one or more of a snap-fit, interference fit, screw thread, magnetic, and/or bayonet connection. In other implementations, the end cap may be permanently engaged with the holder 202 after assembly to secure the various components therein. The end cap 214 may be translucent or transparent so as to allow light from the ignitable heat source to pass therethrough when lit. Similarly, the slider button 231 may also be translucent or transparent to allow, for example, light from an LED to pass therethrough that is indicative of a state of the device 200.

In some implementations, the opening 215 in the end cap 214 allows for the introduction of ambient air to the receiving chamber 210 and cartridge 206. However, in other implementations not depicted, the holder may include one or more apertures therein for allowing entrance of ambient air to be directed into the receiving chamber and/or the aerosol passageway (such as, for example, through the substrate cartridge and/or downstream from the substrate cartridge). Thus, when a user draws on the holder (e.g., via the mouthpiece portion thereof), air may be drawn into the receiving chamber and/or the aerosol passageway for inhalation by the user.

FIG. 10 provides an enlarged view illustrating additional details of the mouthpiece 204. In the depicted implementation, the mouthpiece 204 has a first portion 207 having a first end 207*a* and a longitudinally opposed second end 207*b*, and a second portion 205 that extends distally from the longitudinally opposed second end 207*b* of the first portion. The first and second portions 207, 205 define a second aerosol passageway 254 that extends therethrough. The first end 207*a* of the first portion 207 is configured to engage with a user's mouth, while the second end 207*b* of the first portion 207 is configured to engage with the proximal end of the holder 202. The second end 207*b* of the first portion may be configured to engage the opening in the proximal 202*a* end of the holder 202 via at least one of complementary-threaded surfaces for a screw-type engagement, a press-fit engagement, a snap-fit engagement, or a magnetic engagement.

The second portion 205 of the mouthpiece 204 is essentially a hollow stem or tube that extends from the second end 207*b* of the first portion 207 of the mouthpiece 204 and is configured to slidably engage with the slider body 230, which partially defines the aerosol passageway 250, so as to provide fluid communication between the first aerosol passageway and the second aerosol passageway 245. In some implementations, the second portion 205 of the mouthpiece 204 passes through an opening 215' in an endcap 214'. The first portion 207 of the mouthpiece defines a first portion 254*a* of the second aerosol passageway 254 and the second portion 205 of the mouthpiece 204 defines a second portion 254*b* of the second aerosol passageway 254. The second portion 205 of the mouthpiece is offset from a central axis of the device 200. Specifically, the second portion 205 comprises a centrally located longitudinal axis 297*b* offset from and generally in parallel with a centrally located longitudinal axis 297*a* of the device 200, such that the second portion 205 of the mouthpiece, and the second aerosol passageway portion 254*b*, is aligned with the first aerosol passageway 250 in the sliding body 230 to define a direct vapor path from the cartridge 206 to the mouthpiece 204. As shown in FIG. 8B, the second portion of the second aerosol passageway 254*b* opens into the first portion of the second aerosol passageway 254*a* for delivery to the user. The offset arrangement simplifies the vapor path so as to minimize and/or eliminate loss of vapor (e.g., fewer joints or interfaces results in fewer leak points).

The second portion 205 of the mouthpiece 204 includes a sealing mechanism 263 disposed about an exterior surface thereof, so as to sealingly engage the second portion 205 with the portion of the first aerosol passageway defined by the slider body 230. In some implementations, the sealing mechanism 263 comprises an O-ring 260 disposed within a groove 261 defined by the exterior surface of the second portion of the mouthpiece. In the depicted implementation, the mouthpiece 204 is removably secured to the holder 202 via the sealing mechanism 263, which provides frictional resistance between the mouthpiece 204 (specifically, the second portion 205) and the sliding body 230. In some implementations, the inner housing 224 includes a retention structure 269*a* disposed on a proximal end thereof (e.g., formed in the end cap 214') and the second end 207*b* of the first portion 207 of the mouthpiece 204 defines a mating retention structure 269*b* configured to engage the retention structure 269*a* on the inner housing 224. The retention structure 269 may be a snap-fit mechanism or other type of reversible coupling mechanism. The retention structure 269 may further removably secure the mouthpiece 204 to the holder 202. The mouthpiece 204 can be removed from the holder 202 for, for example, cleaning or customization of the device 200 (e.g., the use of interchangeable mouthpieces).

FIGS. 11A, 11B, 12, and 13 illustrate another example implementation of an aerosol delivery device 300. In particular, FIGS. 11A and 11B illustrate a perspective view and a cross-sectional side view, respectively, of an aerosol delivery device 300 that includes a removable mouthpiece 304. Specifically, the aerosol delivery device 300 comprises a holder 302 having a main body defining a proximal end 302*a* and a distal end 302*b*, where the holder 302 further defines a receiving chamber 310 configured to receive a removable cartridge (306 in FIG. 12) and a first aerosol passageway 350 that extends through at least a portion of the main body. In some implementations, the removable cartridge 306 comprises an ignitable heat source 320 and a substrate portion 322 that includes a substrate material having an aerosol precursor composition configured to form an aerosol upon application of heat thereto. The holder 302 further comprises an access door 388 that may be slidingly or hingedly coupled to the holder 302 and configured to be opened for loading the cartridge 306 into the receiving chamber 310 via the receptacle 338 in the inner housing 324 (see FIG. 12). The device 300 also includes a mouthpiece 304 removably secured to the holder 302 and described in greater detail below.

As further illustrated by the exploded view of FIG. 12, the device 300 includes an inner housing 324 disposed within the holder 302 and further defining the receiving chamber 310 and a receptacle 338 for receiving the cartridge 306. A proximal end of the inner housing 324 includes a retention mechanism 369 configured to engage with the mouthpiece 304 as described below. The inner housing 324 includes a tubular structure 325 disposed therein and extending along a length of the housing 324. The tubular structure 325 defines the first aerosol passageway 350 and extends partially beyond the proximal end of the inner housing 324 and is configured to engage at least a portion of the mouthpiece 304 to provide fluid communication between the first and second aerosol passageways 350, 354 and deliver the aerosol to a user via an opening 358 in the mouthpiece 304.

The receiving chamber 310 of the device 300 is further defined by an end cap 314 engaged with the distal end 302*b* of the holder 302 and defining an opening 315 configured to pass the removable cartridge 306 therethrough when ejected. The actuator assembly 308 is slidably disposed within the main body of the holder 302 and configured to eject the cartridge 306 when slid forward towards the distal end of the holder 302. In some implementations, the actuator assembly 308 is spring-loaded so as to return the actuator assembly 308 to a neutral position. The cartridge 306 may be removably secured within the receiving chamber 310 and sealed relative to the first aerosol passageway 350 via any of the mechanisms or manners disclosed herein (e.g., frictionally engaged via an elastomeric seal).

The device 300 further includes a power source 312 and a printed circuit board 318 disposed within the inner housing 324. The power source 312 is in electrical communication with the printed circuit board 318 and a pair of static ignitor contacts 328 disposed thereon that may be energized via a push button 340 disposed on a side wall of the holder 302. Specifically, once the push button 340 is actuated, the electrical circuit is completed and electricity is delivered to the ignitor contacts 328. The printed circuit board 318 may further comprise a charging port 319 that is oriented on the printed circuit board so as to be disposed at one end of the holder 302.

FIG. 13 provides an enlarged cross-sectional view illustrating additional details of the mouthpiece 304. In the depicted implementation, the mouthpiece 304 has a first end 304*a* and a longitudinally opposed second end 304*b* with a second aerosol passageway 354 extending longitudinally therebetween. In the depicted implementation, the mouthpiece 304 is located at the proximal end of the holder 302, with the first end 304*a* configured to engage with a user's mouth and the second end 304*b* configured to engage the proximal end of the holder 302. The mouthpiece 304 is configured to sealingly engage with the holder 302 so that the first and second aerosol passageways 350, 354 are in fluid communication so as to deliver the aerosol generated in the receiving chamber to the user.

In the depicted implementation, the removable mouthpiece 304 comprises a hollow body 356 (i.e., recess) and a stem 305 (or similar tubular structure) disposed within the hollow body 356 and extending from the first end 304*a* to the second end 304*b*. The stem 305 defines the second aerosol passageway 354 extending therethrough and is engaged with the inner housing 324 so as to fluidly couple with the aerosol passageway 350 of the inner housing 324. The stem 305 may be coupled to the inner housing 324 via, for example, a press-fit or snap-fit engagement with the tubular structure 325 within the inner housing 324. In some implementations, the stem 305 is sealingly engaged with the first aerosol passageway 350 in the holder 302. For example, the stem 305 may include a sealing mechanism 359 similar to any of those disclosed herein.

In some implementations, the stem 305 of the mouthpiece 304 is offset from a central axis of the device 300. Specifically, the stem 305 comprises a centrally located longitudinal axis 397*b* offset from and generally in parallel with a centrally located longitudinal axis 397*a* of the device 300, such that the stem 305 of the mouthpiece, and the second aerosol passageway 354, is aligned with the first aerosol passageway 350 in the inner housing 324 to define a direct vapor path from the cartridge 306 to the mouthpiece 304. As shown in FIG. 13, the second aerosol passageway 354 opens into a recess or receptacle 367 disposed within the proximal end of the mouthpiece 304 for delivery of the aerosol to the user. The offset arrangement simplifies the vapor path so as to minimize and/or eliminate loss of vapor (e.g., fewer joints or interfaces results in fewer leak points).

FIGS. 12 and 13 further depict the incorporation of an insert 365 into the proximal end of the mouthpiece 304. Specifically, the receptacle 367 formed in the proximal end 304*a* of the mouthpiece 304 is configured to secure the insert 365 therein. The insert 365 may be removably secured in the receptacle 367 via at least one of complementary-threaded surfaces for a screw-type engagement, a press-fit engagement, a snap-fit engagement, or a magnetic engagement. The insert 365 defines a cavity 371 in fluid communication with the second aerosol passageway 354 and an outlet 358 for delivering the aerosol to the user. Generally, the insert 365 allows for customization of the device 300 (e.g., different size outlets, aerosol conditioning, incorporation of a flavoring, etc.) and may be easily removed for cleaning.

In some implementations, the longitudinally opposed second end 304*b* is configured to engage an opening in the proximal end 302*a* of the holder via at least one of complementary-threaded surfaces for a screw-type engagement, a press-fit engagement, a snap-fit engagement, or a magnetic engagement. In other implementations, the mouthpiece 304 is removable secured to the holder 302 via a sealing mechanism that provides frictional resistance between the mouthpiece 304 and the holder 302 or other component therein. In some implementations, the inner housing 324 includes a retention structure 369*a* disposed on a proximal end thereof and the second end 304*b* of the mouthpiece 304 defines a mating retention structure 369*b* configured to engage the retention structure 369*a* on the inner housing 324. The retention structure 369 may be a snap-fit mechanism or other type of reversible coupling mechanism. The retention structure 369 may further removably secure the mouthpiece 304 to the holder 302. The mouthpiece 304 can be removed from the holder 302 for, for example, cleaning or customization of the device 300 (e.g., the use of interchangeable mouthpieces) by, for example, application of a pulling or twisting action to the mouthpiece 304 or actuating a release.

FIGS. 14A, 14B, and 15 illustrate another example implementation of an aerosol delivery device 500. In particular, FIGS. 14A and 14B illustrate a perspective view and a cross-sectional perspective view, respectively, of an aerosol delivery device 500 that includes a removable mouthpiece 504 and a removable flow restrictor 565. Specifically, the aerosol delivery device 500 comprises a holder 502 having a main body defining a proximal end 502*a* and a distal end 502*b*, where the holder 502 further defines a receiving chamber 510 configured to receive a removable cartridge 506 and an aerosol passageway 550 that extends through at least a portion of the main body. The removable cartridge 506 comprises an ignitable heat source 520 and a substrate portion that includes a substrate material having an aerosol precursor composition configured to form an aerosol upon application of heat thereto. The mouthpiece 504 has a first end configured to engage with a user's mouth and a longitudinally opposed second end with a second aerosol passageway 554 extending longitudinally therebetween. In the depicted implementation, the mouthpiece 504 is coupled to the proximal end 502*a* of the holder 502 via a body portion 555 disposed at the distal end of the mouthpiece 504. The body portion 555 is configured to removably and/or sealingly engage an opening in the proximal end of the holder 502.

Disposed generally between the holder 502 and the mouthpiece 504 is the removable flow restrictor 565 (see FIGS. 16A and 16B). The flow restrictor 565 comprises an outer surface 565*c* configured to be removably secured within the holder and an inner surface 565*d* defining a third aerosol passageway 553, where the flow restrictor is configured to be at partially disposed within the first aerosol passageway 550, the second aerosol passageway 554, or both. In some embodiments, the inner surface 565*d* of the flow restrictor 565 is tapered along a length thereof and defines an orifice 515 at the proximal end thereof that can be configured to provide a pressure drop between the first aerosol passageway 550 and the second aerosol passageway 554 when installed. However, the inner surface 565*d* may define a variety of profiles (e.g., cylindrical, stepped, etc.) to suit a particular application. In some embodiments, the removable flow restrictor 565 is configured to sealingly engage with the first aerosol passageway, the second aerosol passageway, or both. Alternatively, or additionally, the flow restrictor 565 may be removably secured in the holder 502 via at least one of complementary-threaded surfaces for a screw-type engagement, a press-fit engagement, a snap-fit engagement, a frictional engagement, or a magnetic engagement.

As shown in FIGS. 16A and 16B, the flow restrictor 565 comprises a body portion 565*a* and a lip portion 565*b* disposed at a proximal end thereof with both defined by the outer surface 565*c*. As can be seen in FIG. 14B, the body portion 565*a* is disposed within the first aerosol passageway 550 with the lip portion 565*b* configured to engage the proximal end 502*a* of the main body and disposed within the second aerosol passageway 554 as described in greater detail below. The third aerosol passageway 553 provides fluid communication between the first aerosol passageway 550 and the second aerosol passageway 554. The overall size, shape, and finish of the flow restrictor 565 will be selected to suit a particular application (e.g., manner and location of installation, performance characteristics, etc.) For example, the outer surface 565*c* may have a surface finish that enhances the fit and sealing of the flow restrictor 565 with the first and/or second aerosol passageways 550, 554, or include one or more grooves for holding a sealing arrangement (e.g., an O-ring) for sealing and/or frictionally engaging with the passageways 550, 554.

The mouthpiece 504 is removable so that the flow restrictor 565 may be easily removed for cleaning or replacement to, for example, change an operating characteristic of the device. Generally, the removable flow restrictor 565 allows for customization of the device 500, specifically, the user's experience with the device 500. For example, the flow restrictor 565 may have different size outlets, aerosol passageway configurations, thermal properties (e.g., for enhanced temperature control of the aerosol delivered to the user), or even the incorporation of a flavoring.

In the depicted implementation, the mouthpiece 504 is coupled to the holder 502 via the body portion 555 as disclosed above. The body portion 555 is sized and shaped to engage an opening in the proximal end of the holder 502, such that the body portion 555 is disposed within the proximal end of the holder 502, with or without a sealing mechanism, so as to be substantially flush with the proximal end 502*a* of the holder. In some implementations, the body portion 555 may be coupled to the holder 502 via at least one fastener (e.g., a screw) and/or physically engage an inner wall of the holder 502. The mouthpiece 504 further comprises a nozzle or extension 505 that makes up the first end of the mouthpiece and is configured to be engaged by the user's mouth. The nozzle 505 partially defines the second aerosol passageway 554 and terminates at an opening 558 configured to pass the generated aerosol to the user.

At the opposing side of the body portion 555, a hollow stem 507 extends into the holder when assembled. Specifically, in some implementations, the main body of the holder 502 includes a tubular structure 521 disposed therein and extending along a length of the holder 502. The tubular structure 521 at least partially defines the first aerosol passageway 550 and extends towards the proximal end of the holder 502 and is configured to engage at least a portion of the mouthpiece 504 to provide fluid communication between the first and second aerosol passageways 550, 554 and deliver the aerosol to a user via the opening 558. In the depicted implementation, the stem 507 engages with the tubular structure 521 with the flow restrictor essentially "sandwiched" therebetween. In some implementations, the flow restrictor 565 is first inserted into the tubular structure 521 of the holder so that the lip thereof abuts the proximal end of the tubular structure 521, and then the mouthpiece 504 is secured to the proximal end of the holder 502 such that the stem 507 passes over the flow restrictor 565 and the proximal end of the tubular structure 521, fluidly coupling the first, second, and third aerosol passageways 550, 554, 553.

The mouthpiece 504 may be coupled to the holder 502 via an amount of frictional resistance sufficient to secure the mouthpiece 504 to the holder 502, but minimal enough so that a user may remove the mouthpiece 504 without significant effort. For example, the mouthpiece may be removed from the holder by, for example, application of a pulling or twisting action to the mouthpiece 504 or actuating a release. The mouthpiece can be removed for access to the flow restrictor, which can then be removed for cleaning or replacement to customize the user's experience. The mouthpiece 504 may also be cleaned and/or replaced after removal.

The holder 502 further comprises an access door assembly 589 pivotably coupled to the main body via a pivot assembly 584 (e.g., pivot pin 584*a*, receptacle 584*b*), although in some implementations, the door assembly 589 may be slidingly or hingedly coupled to the holder 502. As depicted in FIGS. 14A and 15, the door assembly 589 includes a door 588 configured to fit substantially flush with an outer surface of the holder 502 in a closed configuration and sized and shaped to receive a chassis or inner housing 524 defining the receiving chamber 510 for receiving the cartridge 506 therein. The chassis 524 may comprise a plurality of material layers that provide for temperature control of the device, for example, thermal insulation to prevent heat from the cartridge being transferred to the holder and a user contacting a "hot" device. The assembly 589 further comprises a pair of static ignitor contacts 528 disposed proximate the distal end 502*b* of the holder, a seal mechanism 560 configured to sealingly engage the receiving chamber 510 with the first aerosol passageway, and a biasing mechanism 542 configured to urge a loaded cartridge into contact with the ignitor contacts 528 when in the closed configuration. The door assembly 589 is moved between its open configuration and closed configuration via a spring-loaded slider button as discussed in greater detail with respect to FIGS. 17A-17C.

The device 500 further comprises a power source 512 and a printed circuit board 518 disposed within the holder 502. The power source 512 is in electrical communication with the printed circuit board 518 and the static ignitor contacts 528. The printed circuit board 518 includes electrical contacts 529 (e.g., pogo pins) that contact the ignitor contacts 528 when the door assembly 589 is in the closed configuration. The printed circuit board 518 may further comprise a charging port 519 (e.g., a micro-USB connector) that is oriented on the printed circuit board so as to be disposed at one end of the holder 502.

In the depicted implementation, an ignitor push button 540 is disposed in a side wall of the holder 502 and configured, so that when pressed by a user, activates the ignitor contacts 528 thereby igniting the heat source 520 of the cartridge 506 to produce the aerosol. Specifically, once the push button 540 is actuated, the electrical circuit is completed and electricity is delivered to the ignitor contacts 528. In some implementations, the ignitor contacts 528 will only remain activated while the ignitor push button 540 is depressed. As such, in some implementations, the ignitor contacts 528 will be deactivated when the ignitor push button 540 is released. In some implementations, the ignitor push button 540 may be configured to activate the ignitor contacts 528 for a set time after release. In one implementation, the push button 540 extends through an opening 563 in the holder 502. In some implementations, the button 540 is spring loaded and may return to an off position after igniting the heat source. The device 500 may further include an LED ring 541 proximate the push button 540 that may illuminate during ignition and/or change colors to indicate a state of the device 500.

FIGS. 17A-17C illustrate the loading and ejecting of the cartridge (i.e., consumable) 506 relative to the device 500. Specifically, FIG. 17A depicts the door assembly 589 in the closed configuration with the door assembly 589 enclosing the receiving chamber 510 within the holder 502. In order to move the door assembly into the open configuration, the spring-loaded slider button 508 is slid forward or distally so as to release the door assembly 589 from the holder 502. The door assembly 589 is biased into the open configuration as shown in FIG. 17B, thereby exposing the chassis 524 and the receiving chamber 510 disposed therein. As further shown, the cartridge is inserted into the receiving chamber 510 with the ignitable heat source 520 end inserted first. Once the cartridge 506 is loaded, the door assembly 589 is pushed closed (the biasing force is small enough that a user may close the door assembly with a single finger) and the slide button 508 reconnects to the holder 502 to secure the door assembly 589 in the closed configuration as shown in FIG. 17A.

In the closed configuration, the cartridge 506 is secured within the holder so as to be in fluid communication with the first aerosol passageway 550 (see FIG. 14B). The ignitable heat source 520 is in contact with the ignitor contacts 528 via the biasing mechanism 542 and may be ignited so that the cartridge may be consumed (i.e., aerosol generated and delivered to the user via the aerosol passageways). After which, the cartridge 506 may be ejected from the device 500 as shown in FIG. 17C. Specifically, the slide button 508 is slid forward or distally so as to release the door assembly 589 and expose the cartridge 506. Once in the open configuration, the device 500 may be turned upside-down, which allows the cartridge to fall out of the receiving chamber 510. After ejection, a user may insert a new cartridge or simply close the door assembly 589 for later use. In some implementations, the device 500 may include a latching mechanism (not shown) configured to further secure the access door assembly 589 in the closed configuration. In some implementations, the latching mechanism may include a magnetic engagement, a threaded interface, a snap-fit, a detent, and/or be spring-loaded into the closed configuration.

FIGS. 18A, 18B, 19, and 20A-20C illustrate another example implementation of an aerosol delivery device 700. In particular, FIGS. 18A and 18B illustrate a perspective view and a cross-sectional perspective view, respectively, of an aerosol delivery device 700 that includes a removable cartridge 706, a mouthpiece 704, a slider assembly 708, and an ignition push button 740. The aerosol delivery device 700 includes a two-part holder 702 defining a linear vapor path 743 and comprising an upper body portion 701 and a lower body portion 703, each defining a proximal end and a distal end.

The lower body portion 703 defines a receiving chamber 710 disposed therein and configured to receive a removable cartridge 706 comprising an ignitable heat source 720 and a substrate portion that includes a substrate material having an aerosol precursor composition configured to form an aerosol upon application of heat thereto. The lower body portion 703 includes a pair of actuatable ignitor contacts 728 disposed proximate the distal end thereof and coupled thereto via a pair of contact arms 726. The actuatable ignitor contacts 728 are configured to be engaged with the ignitable heat source 720 when the removable cartridge 706 is secured within the receiving chamber 710. Additionally, the lower body portion 703 includes a window 782 disposed therein and configured to provide a view of at least a portion of the receiving chamber 710 so that a user may observe the cartridge 708 and/or electrical contacts 728. All or a portion of the window 782 may comprise a transparent or translucent material (e.g., a polycarbonate, polyethylene terephthalate, acrylic, or the like). In some implementations, a portion of the lower body portion 703 may be made from a transparent or translucent material.

The upper body portion 701 defines a first aerosol passageway 750 extending therethrough and houses a power source 712, a printed circuit board 718 with associated electronics, and the sliding actuator assembly 708. The sliding actuator assembly 708 is slidably disposed within the upper body portion 701, specifically within the first aerosol passageway 750, and is configured to eject the removable cartridge from the lower body portion 703. The upper body portion 701 and the lower body portion 703 are movably coupled together via one or more mechanisms 784 (e.g., a swivel joint), so that the lower body portion 703 may rotate relative to the upper body portion 701 between an open configuration exposing the receiving chamber 710 so that the removable cartridge may be loaded therein, and a closed configuration where the receiving chamber 710 and the first aerosol passageway 750 are in fluid communication and configured to deliver the aerosol generated from the cartridge to the mouthpiece 704.

Additionally, the device 700 may include a sealing mechanism 772 disposed between the proximal end of the lower body portion 703 and the distal end of the upper body portion 701 (e.g., an O-ring disposed within a groove in the face of the proximal end of the lower body 703) and configured to seal the receiving chamber 710 with the first aerosol passageway 750 so as to prevent aerosol leakage from the vapor path 743 and/or the ingress of ambient air. In some implementations, the aerosol delivery device 700 further comprises a locking mechanism 785 disposed on at least one of the lower body portion 703 or the upper body portion 701 that is configured to maintain the device in a closed orientation (i.e., the upper and lower body portions aligned and in fluid and/or electrical communication. The locking mechanism 785 may include, for example, one or more of magnets, friction, a snap fit, or a detent. However, in some other implementations, the upper body portion 701 and the lower body portion 703 are integrally formed together, or may be fixedly coupled with one another. Other manners of movably coupling the upper body portion 701 and the lower body portion 703 include a hinge joint, a sliding track, and the like.

The mouthpiece 704 is located at the proximal end of the upper body portion 701 and has a first end and a longitudinally opposed second end with a second aerosol passageway 754 extending longitudinally therebetween. In the depicted implementation, the first end of the mouthpiece 704 is configured to engage with a user's mouth and the second end is configured to engage the proximal end of the upper body portion 703. The mouthpiece 704 is configured to sealingly engage with the upper body portion 701 so that the first and second aerosol passageways 750, 754 are in fluid communication so as to deliver the aerosol generated in the receiving chamber 710 to the user via the vapor path 743. The mouthpiece 704 may be removably coupled to the upper body portion 701 to, for example, provide for cleaning or customization of the device 700. However, in other implementations, the mouthpiece 704 may be integrally formed with the upper body portion 701.

As further illustrated by the exploded view of FIG. 19, the slider actuator assembly 708 comprises a generally tubular slider body 730 disposable within the upper body portion 701 so as to slide along a length of the upper body portion 701 in a first direction and a second direction. The slider body 730 defines a passageway extending therethrough that forms a third aerosol passageway 738 aligned with and extending through the first aerosol passageway 750 of the upper body portion 701. The slider body 730 includes a first protrusion 731 extending from an outer surface thereof and extending through an opening 716 in a wall of the upper body portion 701 that is configured to move the slider body 730 between a loading position (e.g., slider body 730 fully disposed within the upper body portion 701) and an ejecting position (e.g., the slider body 730 moved distally within the device 700. The slider body 730 further includes a second protrusion or stem 733 extending from a distal end thereof. The stem 733 is configured to engage the removable cartridge 706 so as to advance the removable cartridge through the distal end of the lower body portion 703 when the actuator assembly 708 is moved into the ejecting position. Portions of the protrusions 731, 733 extend into the third aerosol passageway 738 such that the vapor path 743 splits around those portions. Specifically, one or more portions of the first protrusion, the second protrusion, or both may extend into the portion of the third aerosol passageway 738 within the slider body 730 so that the aerosol generated by the cartridge 706 and pulled into the mouthpiece 704 is split by the one or more portions when traveling through the tubular body. In some implementations, the slider body 730 comprises a longitudinally oriented baffle 739 extending inwardly from an interior wall thereof, where the baffle divides the aerosol passageway 738 extending through slider body.

The upper body portion 701 further defines two cavities 707, 709, where the first cavity 707 further defines the first aerosol passageway 750 and is configured to receive the slider body 730 therein, and the second cavity is configured to house the power source 712 and the printed circuit board 718. Additionally, the actuator assembly 708, specifically the slider body 730, includes a sealing arrangement for sealingly engaging with an internal surface of the first cavity 707 (e.g., to avoid aerosol leakage or undesirable air ingress). In the depicted implementation, the sealing arrangement comprises a pair of O-rings 760 disposed within grooves 761 disposed proximate the distal and proximal ends of the slider body 730. However, other configurations of the sealing arrangement are contemplated and considered within the scope of the disclosure.

The lower body portion 703 also defines two cavities 707', 709' that are generally aligned with the cavities 707, 709 of the upper body portion 701 when in the closed configuration. Specifically, the first cavity 707' at least partially defines the receiving chamber 710 and opposing openings 715, 715' and in some implementations includes a bar 711 or other structure for supporting the window 782 and/or guiding the cartridge 706 during insertion. In the depicted implementation, the lower body portion 703 defines a cut-out or other opening that exposes the receiving chamber 710 and is configured to receive the window 782 therein. The window 782 may be installed or otherwise coupled to the lower body portion 703 via an adhesive, snap fit, or other means known in the art. The cavity 707'/receiving chamber 710 includes a groove or other structure for securing a retention mechanism 776 therein that frictionally and/or sealingly engages with an outer surface of the cartridge 706 as described below. In the depicted implementation, the retention mechanism 776 is an O-ring.

The second cavity 709' is generally configured to house various electronics and other mechanisms necessary to provide power to the ignitor contacts 728 and actuate same for igniting the heat source 720 of the cartridge 706. For example, the contact arms 726 are electrically coupled to the power source within the second cavity 709' and extend through a wall of the second cavity 709' so as position the ignitor contacts 728 within the receiving chamber 710. The lower body portion 703 further defines a set of openings 763 therethrough that are configured to engage with the actuator buttons 740 and light emitting diodes (LED) 741 that are disposed on both sides of the lower body portion 703 and are described below.

The operation of the device 700 generally, and the slider actuator assembly 708 specifically, is described with respect to FIGS. 20A-20C. Specifically, FIG. 20A represents the cartridge 706 being loaded into the device 700 (i.e., the actuator assembly in the loading position), FIG. PA3-11B represents the device 700 during ignition and smoking, and FIG. 20C represents the cartridge 706 being ejected from the device 700 (i.e., the actuator assembly in the ejection position).

Referring to FIG. 20A, in order to load the cartridge 706 into the receiving chamber 710, the lower body portion 703 is rotated or otherwise offset (e.g., twisted) from the upper body portion 701 so as to expose the receiving chamber via opening 715'. Prior to rotating the body portions, the actuator assembly 708 is moved into the loading position (i.e., fully retracted towards the mouthpiece 704) so that the sliding body 730 is fully disposed within the first cavity 707 of the upper body portion 701. The cartridge 706 is manually inserted into the receiving chamber 710 of the lower body portion 703, so as to locate the cartridge 706 into a lighting and/or use positon, where the cartridge is sealingly secured within the chamber 710 via the retention mechanism 776 so that the ignitable heat source 720 operatively aligns with the ignitor contacts 728. After loading, the upper and lower body portions are moved back into alignment so that the sealed end of the cartridge 706 is in fluid communication with the first aerosol passageway 750. The fit between the upper and lower body portions is such that there is no aerosol leakage or air ingress therebetween, with or without the use of additional sealing arrangements as described above.

With reference to FIG. 20B, in the lighting/use position, the distal end of the cartridge 706 is located proximate the distal end of the lower body portion 703 such that the entire cartridge 706 is located inside of the receiving chamber 710. In particular, in the lighting/use position of the depicted implementation, the heat source 720 portion of the cartridge 706 is also positioned proximate the distal end of the lower body portion 703 and aligned with the ignitor contacts 728 in the lighting position. The heat source 720 is ignited via the aligned push buttons 740 disposed on the opposite sides of the lower body portion 703 of the aerosol delivery device 700. The buttons 740 are movably coupled to the lower body portion, with or without a sealing arrangement, so that a user may depress both buttons simultaneously (e.g., via a pinching action) so as to engage and deflect the contact arms 726 and by extension move the ignitor contacts 728 into contact with the ignitable heat source 720. Once released, the buttons 740 return to their original position, at least in part via a spring action from the deflected contact arms 726 and/or a return biasing element. In some implementations, the ignitor contacts 728 will only remain activated while the ignitor push buttons 740 are depressed. As such, in some implementations, the ignitor contacts 728 will be deactivated when the ignitor push buttons 740 are released. In some implementations, the ignitor push buttons 740 may be configured to activate the ignitor contacts 728 for a set time after release. The device 700 also includes a pair of LEDs 741 that may illuminate during ignition and/or change colors to indicate a state of the device 700. Additionally, a user may be able to observe ignition via the window 782.

In some implementations, the device 700 may include an ejection mechanism as shown in FIG. 20C. Generally, the ejection mechanism is configured to eject the cartridge 706 from the distal end of lower body portion 703 via opening 715. Between loading and ejection, the cartridge 706 passes through the second cavity 709'. In one implementation, the ejection mechanism is incorporated in to the actuator assembly 708, so that when the slider protrusion 731 (and actuator assembly 708) is moved forward, the ejection mechanism engages one end of the cartridge 706 and pushes the cartridge out of the receiving chamber 710 and out of the aerosol delivery device 700 through the opening 715 in the lower body portion 703. Specifically, a user can slide the actuator assembly 708 forward (i.e., away from the mouthpiece) using, for example, their thumb and the protrusion 731 so that the inner stem 733 of the slider body 730 enters into the cavity 707' of the lower body portion 703 and engages the cartridge 706 pushing it forward and disengaging the cartridge from the retention mechanism 776. After which, the cartridge 706 may be pulled out of or allowed to drop out of the device 700.

In the depicted implementations, the outer housing or holder may comprise a rigid material. For example, the holders 102, 202, 302, 402, 502, 702 of the depicted implementations may be constructed of an aluminum material; however, in other implementations, the holders may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Pub. No. 2020/0128880 to Gage et al., which is incorporated herein by reference in its entirety. Other examples of cartridges are described herein below with respect to FIGS. 21 and 22.

In some implementations, the holder (or any components thereof, such as inner housings, collars, etc.) may be made of moldable plastic materials such as, for example, polycarbonate, polyethylene, acrylonitrile butadiene styrene (ABS), polyamide (Nylon), or polypropylene. In other implementations, the holder may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof. The holders may be formed via extrusion. As noted above, the mouthpiece portion of some implementations is separable from the main body, while in other implementations, the mouthpiece portion may be integral with the main body. In any event, the mouthpiece portion and the main body may be made of the same material or different materials. In various implementations comprising a separable mouthpiece portion, the mouthpiece portion may be coupled to the main body in a variety of ways, including, for example, via one or more of a snap-fit, interference fit, screw thread, magnetic, and/or bayonet connection. In other implementations, the mouthpiece portion may be integral with the main body and thus may not be separable.

In the depicted implementations, the holder includes walls that are substantially solid and non-porous; however, in other implementations one or more of these walls of a holder may have other configurations. For example, in some implementations one or more of the walls of a holder may be non-solid and/or substantially porous or may include one or more non-solid and/or substantially porous portions. In some implementations, for example, the holder may include one or more apertures that may facilitate access of oxygen to the heat source. Alternatively, or additionally, other implementations may include one or more apertures that may mix with the aerosol generated during a draw. In such a manner, in the use position the one or more apertures may be located proximate the heat source, thus providing the heat source with additional access to oxygen during combustion. In some implementations, the holder may include one or more apertures downstream from the heat source. For example, in some implementations the holder may include apertures that extend into the aerosol passage of the holder that may mix with aerosol generated by the substrate material of the cartridge.

As described above, the holder of various implementations of the present disclosure includes a lighting/use position. In some implementations, the holder may also have an extinguishment position. In such a manner, the extinguishment position may be configured such that the heat source of a cartridge is deprived of sufficient oxygen to sustain combustion. In some implementations, the extinguishment position may be obtained by a further action of the holder. In other implementations, one or more additional features may be included such that an extinguishment position may be achieved by actuating the one or more additional features. In particular, the holder of one implementation may include an air impermeable cover feature located proximate the distal end of the holder that may be mechanically or manually actuatable (e.g., by rotating the cover feature over the end of the main body and/or by sliding the cover feature across the end of the main body) such that in the extinguishment position, the cover feature substantially covers the open end of the holder and the heat source of the cartridge is deprived of sufficient oxygen to sustain combustion. In another implementation, the holder may include a detachable feature, such as, for example, an end cap, that may be used to achieve the extinguishment position. For example, in some implementations a separate end cap may be attachable over the distal end of the holder such that, once attached, the heat source of the cartridge is deprived of sufficient oxygen to sustain combustion. Such an end cap could also be used to cover the end of the second body portion when not in use, such as, for example, to prevent dirt and/or foreign objects from entering into the device. Additionally, or alternatively, in some implementations the holder of the present disclosure may include an air permeable cover feature (e.g., a cover feature comprising a plurality of openings or a cover feature comprising a mesh) that protects the heat source of the cartridge in the lighting/use position. For example, the holder of one implementation may include an air permeable cover feature located proximate the distal end of the holder that may be mechanically or manually actuatable (e.g., by rotating the cover feature over the end of the holder and/or by sliding the cover feature across the end of the holder) such that once ignited, the cover feature may be actuated to substantially cover the open end of the holder while maintaining sufficient access of oxygen to the heat source.

In various implementations, a removable cartridge may have other configurations for use with a holder of the present disclosure. For example, FIG. 21 illustrates a perspective view of a removable cartridge 606, according to another example implementation of the present disclosure. In the depicted implementation, the cartridge 606 defines a proximal end 690 and a distal end 692. The cartridge 606 of the depicted implementation further includes an ignitable heat source 620, which comprises a fuel element 694, a substrate portion 622, which comprises a substrate material 696 (see FIG. 22), and an outer housing 698 configured to circumscribe at least a portion of the ignitable heat source 620 and the substrate material 622. It should be noted that although in the depicted implementation the cartridge 606 has a substantially cylindrical overall shape, in various other implementations, the cartridge or any of its components may have a different shape. For example, in some implementations the cartridge (and/or any of its components) may have a substantially rectangular shape, such as a substantially rectangular cuboid shape. In other implementations, the cartridge (and/or any of its components) may have other hand-held shapes. Some examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

In some implementations, a barrier may exist between the heat source and the substrate material. In some implementations, such a barrier may comprise a disc that may include one or more apertures therethrough. In some implementations, the barrier may be constructed of a metal material (such as, for example, stainless steel, aluminum, brass, copper, silver, gold, bronze, titanium, various alloys, etc.), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. Pat. App. Pub. No. 2019/0281891 to Hejazi et al., which is incorporated herein by reference in its entirety. In some implementations, a barrier and/or a heat transfer component may prevent or inhibit combustion gasses from being drawn through the substrate material (and/or from being drawn through air passageways through which aerosol is drawn).

In various implementations, the heat source may be configured to generate heat upon ignition thereof. In the depicted implementation, the ignitable heat source 620 comprises a combustible fuel element 694 that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Some carbonaceous materials may be composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible. Although specific dimensions of an applicable heat source may vary, in the depicted implementation, the ignitable heat source 620 has a length in an inclusive range of approximately 5 mm to approximately 20 mm, and in some implementations may be approximately 12 mm, and an overall diameter in an inclusive range of approximately 3 mm to approximately 8 mm, and in some implementations may be approximately 4.8 mm (and in some implementations, approximately 7 mm).

Although in other implementations the heat source may be constructed in a variety of ways, in the depicted implementation, the ignitable heat source 620 is extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

In various implementations, the heat source may have a variety of forms, including, for example, a substantially solid cylindrical shape or a hollow cylindrical (e.g., tube) shape. In other implementations, the heat source may comprise a plurality of hollow or substantially solid spheres, which in some implementations may comprise substantially the same size, and in other implementations may comprise more than one size. In various implementations, the heat source may be made in variety of ways, including, but not limited to, via extrusion, injection molding, compression molding, etc. The ignitable heat source 620 of the depicted implementation comprises an extruded monolithic carbonaceous material that has a generally cylindrical shape that includes a plurality of internal passages 691 extending longitudinally from a first end of the ignitable heat source 620 to an opposing second end of the ignitable heat source 620. In the depicted implementation there are approximately thirteen internal passages 691 comprising a single central internal passage 691*a*, six surrounding internal passages 680*b*, which are spaced from the central internal passages 691*a* and have a similar size (e.g., diameter) to that of the central internal passage 691*a*, and six peripheral internal passages 691*c*, which are spaced from an outer surface of the ignitable heat source 620 and are smaller in diameter than that of the central internal passage 691*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. Pat. App. Pub. No. 2019/0254335 to Spicer et al., which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements is appreciated upon consideration of commercially available electronic smoking articles, such as those representative products listed in the background art section of the present disclosure.

FIG. 22 illustrates a longitudinal cross-section view of the cartridge 606 of FIG. 21. As shown in the figure, the substrate material 622 of the depicted implementation has opposed first and second ends, with the ignitable heat source 620 disposed adjacent the first end of the substrate material 622. Although dimensions and cross-section shapes of the various components of the cartridge may vary due to the needs of a particular application, in the depicted implementation the cartridge 606 may have an overall length in an inclusive range of approximately 10 mm to approximately 50 mm and a diameter in an inclusive range of approximately 2 mm to approximately 20 mm. In addition, in the depicted implementation the outer housing 698 may have a thickness in the inclusive range of approximately 0.05 mm to 0.5 mm. Furthermore, in the depicted implementation the substrate portion 622 may have a length in the inclusive range of approximately 5 mm to 30 mm and a diameter slightly less than that of the overall cartridge in order to accommodate the thickness of the housing 698, such as, for example, a diameter in an inclusive range of approximately 2.9 mm to approximately 9.9 mm. In the depicted implementation, the substrate material 622 comprises tobacco beads, which may have diameter sizes in range of approximately 0.5 mm to 2.0 mm, although in other implementations the size may differ. In other implementations, the substrate material may be a granulated tobacco material or cut filler tobacco. Although other implementations may differ, in the depicted implementation the outer housing 698 of the cartridge 606 is filled to about 80-90% capacity to allow for insertion of the fuel element 694.

In the depicted implementation, the substrate portion 622 comprises a substrate material 696 having a single segment, although in other implementations the substrate portion may include one or more additional substrate material segments. For example, in some implementations, the aerosol delivery device may further comprise a second substrate material segment (not shown) having opposed first and second ends. As described above, in various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions and/or components for use in a substrate material (and/or substrate materials) are described above. Reference is also made to the discussion above regarding various possible shapes, aerosol precursor compositions, additives, flavorants, etc. of the substrate material.

As shown in FIGS. 21 and 22, the outer housing 698 of the cartridge 606 of the depicted implementation is configured to circumscribe at least a portion of the substrate portion 622, including the substrate material 696. In the depicted implementation, the outer housing 698 is also configured to circumscribe a portion of the ignitable heat source 620. In some implementations, the outer housing may circumscribe the entire heat source. In the depicted implementation, the outer housing comprises a rigid material. For example, the outer housing 698 of the depicted implementation is constructed of an aluminum material; however, in other implementations the outer housing may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Pub. No. 2020/0128880 to Gage et al., which is incorporated herein by reference in its entirety.

In the depicted implementation, the outer housing 698 is constructed as a tube structure that substantially encapsulates the substrate material 622; however, as noted above, in other implementations the outer housing may have other shapes. Although the shape of the outer housing may vary, in the depicted implementation the outer housing 698 comprises a tube structure having an open end and a closed end. The depicted implementation of the outer housing 698 also includes one or more end apertures 693 located on the closed end of the outer housing 698 that are configured to allow aerosolized vapor (herein alternatively referred to as a "vapor" or "aerosol") to pass therethrough. The end apertures 693 of the depicted implementation are in the form of a pair of elongate rounded slots; however, in other implementations the end apertures may have any form that permits passage of the aerosol therethrough. As such, it will be appreciated that the end apertures 693 can comprise fewer or additional apertures and/or alternative shapes and sizes of apertures than those illustrated.

In various implementations, the present disclosure may also be directed to kits that provide a variety of components as described herein. For example, a kit may comprise a holder with one or more cartridges. In another implementation, a kit may comprise a plurality of holders. In further implementations, a kit may comprise a plurality of cartridges. In yet another implementation, a kit may comprise a plurality of holders and a plurality of cartridges. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a cartridge receiving chamber of the holder, or, in other implementations, inserted in a separate aperture that enables a user to remove debris from the cartridge receiving chamber.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

What is claimed is:

1. An aerosol delivery device comprising:

a holder comprising a main body defining a proximal end and a distal end, the main body further defining a receiving chamber configured to receive a removable cartridge and a first aerosol passageway that extends through at least a portion of the main body;

a removable mouthpiece including a first end and a longitudinally opposed second end with a second aerosol passageway extending longitudinally therebetween, wherein the first end is configured to engage with a user's mouth and the second end is coupleable to the proximal end of the holder;

a collar disposed between the holder and the mouthpiece, the collar comprising a first end configured to sealingly engage the proximal end of the holder, a second end configured to sealingly engage the second end of the mouthpiece, and defining a first channel therethrough, the first channel configured to fluidly couple the first and second aerosol passageways; and a charging port, wherein the collar further defines a second channel therethrough, the second channel configured to at least partially house the charging port.

2. The aerosol delivery device of claim 1, wherein the collar further comprises:

a base portion defining an opening in fluid communication with the first channel and having a first sealing mechanism disposed about an exterior surface thereof, the base portion sized and shaped to engage an opening in the proximal end of the holder; and a body portion defining an opening in fluid communication with the first channel and having a second sealing mechanism disposed about an exterior surface thereof, the body portion sized and shaped to engage a recess disposed within the second end of the mouthpiece.

3. The aerosol delivery device of claim 2, wherein the base portion is disposed within the proximal end of the holder.

4. The aerosol delivery device of claim 3, wherein the base portion is coupled to the holder via at least one fastener.

5. The aerosol delivery device of claim 3 further comprising an inner housing configured to secure one or more components therein, wherein the base portion is secured to the inner housing via at least one fastener.

6. The aerosol delivery device of claim 3, wherein the first sealing mechanism comprises an O-ring disposed within a groove defined by the exterior surface of the base portion.

7. The aerosol delivery device of claim 3, wherein the second sealing mechanism comprises at least one O-ring disposed within one or more grooves defined by the exterior surface of the body portion.

8. The aerosol delivery device of claim 1 further comprising an actuator assembly coupled to the holder and configured to eject the removable cartridge therefrom.

9. The aerosol delivery device of claim 1 further comprising a power source disposed within the main body.

10. The aerosol delivery device of claim 9 further comprising:

an inner housing disposed within the main body of the holder; and a printed circuit board in electrical communication with the power source and comprising a controller, wherein the inner housing is configured to receive the power source and the printed circuit board.

11. The aerosol delivery device of claim 10, wherein the printed circuit board further comprises the charging port and the printed circuit board is oriented within the inner housing so that the charging port is disposed at the proximal end of the holder.

12. The aerosol delivery device of claim 1, wherein the collar further comprises:

a base portion defining an opening in fluid communication with the first channel, the base portion sized and shaped to engage an opening in the proximal end of the holder; and a body portion defining an opening in fluid communication with the first channel and having a sealing mechanism disposed about an exterior surface thereof, the body portion sized and shaped to engage a recess disposed within the second end of the mouthpiece.

13. The aerosol delivery device of claim 12, wherein the base portion is configured to engage the opening in the proximal end of the holder via at least one of complementary-threaded surfaces for a screw-type engagement, a press-fit engagement, a snap-fit engagement, or a magnetic engagement.

14. The aerosol delivery device of claim 12, wherein the sealing mechanism comprises at least one O-ring disposed within one or more grooves defined by the exterior surface of the body portion.

15. The aerosol delivery device of claim 12 further comprising an inner housing disposed within the main body of the holder and configured to secure one or more components therein, wherein the inner housing further defines at least a portion of the first aerosol passageway and the base portion of the collar includes a stem extending distally therefrom and configured to engage the at least a portion of the first aerosol passageway in the inner housing.

16. The aerosol delivery device of claim 1 further comprising the removable cartridge, wherein the removable cartridge comprises an ignitable heat source and a substrate portion that includes a substrate material having an aerosol precursor composition configured to form an aerosol upon application of heat thereto.

17. The aerosol delivery device of claim 1, wherein the holder comprises a window disposed therein, the window configured to provide a view of at least a portion of the removable cartridge.

* * * * *